US005989638A

United States Patent [19]

Nielsen

[11] Patent Number: 5,989,638

[45] Date of Patent: Nov. 23, 1999

[54] METHODS AND APPARATUS FOR REDUCING AIR ENTRAPMENT IN SPRAY APPLICATION OF COATINGS TO A SUBSTRATE

[75] Inventor: Kenneth Andrew Nielsen, Charleston, W. Va.

[73] Assignee: Union Carbide Chemicals & Plastics Technology Corporation, Danbury, Conn.

[21] Appl. No.: 08/061,822

[22] Filed: May 13, 1993

Related U.S. Application Data

[63] Continuation of application No. 07/861,375, Mar. 31, 1992, abandoned.

[51] Int. Cl.[6] ..... B05D 1/02; B05B 7/00

[52] U.S. Cl. ..... 427/331; 427/335; 427/421; 427/422; 427/426; 118/300; 118/326

[58] Field of Search ..... 427/331, 335, 427/421, 422, 426; 118/300, 326

[56] References Cited

U.S. PATENT DOCUMENTS

| | | | |
|---|---|---|---|
| 2,355,225 | 8/1944 | MacWilliam | 427/422 |
| 3,597,257 | 8/1971 | Dunn . | |
| 4,132,357 | 1/1979 | Blackinton | 427/421 |
| 4,258,649 | 3/1981 | Dunn . | |
| 4,842,900 | 6/1989 | Miyamoto . | |
| 5,071,900 | 12/1991 | Page et al. | 427/421 |
| 5,108,799 | 4/1992 | Hoy et al. | 427/422 |
| 5,209,948 | 5/1993 | Talacko | 427/421 |

FOREIGN PATENT DOCUMENTS

| | | |
|---|---|---|
| A321607 | 6/1989 | European Pat. Off. . |
| 1239288 | 7/1960 | France . |
| A346465 | 6/1960 | Switzerland . |
| A128658 | 7/1919 | United Kingdom . |

*Primary Examiner*—Katherine A. Bareford
*Attorney, Agent, or Firm*—G T Hampilos; G L Coon; G P Rooney

[57] ABSTRACT

The invention is directed to a method and apparatus for coating substrates by a liquid spray so as to avoid entrapment of gaseous bubbles, particularly air bubbles, in the coating and desirably to thereby obtain bubble-free coatings. More particularly, the invention involves spray applying the coating to a substrate in an atmosphere consisting of gases having appreciable solubility in the applied coating, such as carbon dioxide, such that gas bubbles that may become entrapped in the coating are removed after application by the gases dissolving into the coating and diffusing to the surface.

6 Claims, 2 Drawing Sheets

METHODS AND APPARATUS FOR REDUCING AIR ENTRAPMENT IN SPRAY APPLICATION OF COATINGS TO A SUBSTRATE

This application is a Continuation Division of prior U.S. application Ser. No. 07/861,375 Filing Date Mar. 31, 1992, now abandoned.

Related Patent Applications

This application contains subject matter related to U.S. Pat. No. 4,923,720, issued May 8, 1990, U.S. Pat. No. 5,009,367, issued Apr. 23, 1991, and U.S. Pat. No. 5,057, 342, issued Oct. 15, 1991. This application also contains subject matter related to application Ser. No. 631,680, filed Dec. 21, 1990, now abandoned.

FIELD OF THE INVENTION

This invention, in general, pertains to the field of coating substrates. More particularly, the present invention is directed to methods and apparatus for coating substrates by a liquid spray so as to avoid entrapment of non-soluble gaseous bubbles, typically air bubbles, in the coatings and desirably to obtain bubble-free coatings.

BACKGROUND OF THE INVENTION

Coating compositions are commonly applied to a substrate by passing them under pressure through an orifice into air in order to form a liquid spray, which impacts the substrate and forms a liquid coating. In the coatings industry, three types of orifice sprays are commonly used; namely, air spray, airless spray, and air-assisted airless spray.

Air spray uses compressed air to break up the coating composition into droplets and to propel the droplets to the substrate. The most common type of air nozzle mixes the coating composition and high-velocity air outside of the nozzle to cause atomization. Auxiliary air streams modify the shape of the spray. The coating composition flows through the orifice in the spray nozzle at low pressure, typically less than 18 psi. Air spray is used to apply high quality coatings because of its ability to produce a fine droplet size and a "feathered" spray, that is, the spray has a uniform interior and tapered edges. Such a feathered spray is particularly desirable so that adjacent layers of sprayed coating can be overlapped to form a coating with uniform thickness. However, because of the high air volume that is used, air spray deposits the coating inefficiently onto the substrate, that is, it has low transfer efficiency, which wastes coating.

Airless spray uses a high pressure drop across the orifice to propel the coating composition through the orifice at high velocity. Upon exiting the orifice, the high-velocity liquid breaks up into droplets and disperses into the air to form a liquid spray. The momentum of the spray carries the droplets to the substrate. Spray pressures typically range from 700 to 5000 psi. The spray tip is contoured to modify the shape of the spray, which is usually a round or elliptical cone or a flat fan. Because no compressed air is used, airless sprays deposit the coating composition more efficiently onto the substrate, that is, it has higher transfer efficiency, than air sprays. However, its use is generally limited to applying low quality coatings because it characteristically does not provide a "feathered" spray or fine atomization. Conventional airless spray techniques are known to typically produce coarse droplets and defective spray fans. These deficiencies become less severe if a relatively large concentration of organic solvent is used to lower the atomization viscosity. However, the deficiencies become much more severe if less solvent is used and atomization viscosity is increased in order to reduce solvent emissions. The spray characteristically forms a "tailing" or "fishtail" spray pattern, because surface tension gathers more liquid at the edges of the spray fan than in the center. This produces coarsely atomized jets of coating and a non-uniform spray pattern, which makes it difficult to apply a uniform coating. Airless sprays are generally angular in shape and have a fan width generally equal to the fan width rating of the spray tip being used.

Air-assisted airless spray combines features of air spray and airless spray, with intermediate results. It uses both compressed air and high pressure drop across the orifice to atomize the coating composition and to shape the spray, typically under milder conditions than each type of atomization is generated by itself. The air assist helps to atomize the liquid film and to smooth out the spray to give a more uniform fan pattern. Generally the compressed air pressure and air flow rate are lower than for air spray. Liquid spray pressures typically range from 200 to 800 psi. However, like an air spray, air-assisted airless spray requires a relatively low viscosity, typically below 100 centipoise, and therefore uses a high concentration of organic solvents. The compressed air usage also typically produces lower transfer efficiency than with airless spray.

Airless spray and air-assisted airless spray can also be used with the coating composition heated or with the air heated or with both heated. Heating reduces the viscosity of the coating composition and aids atomization.

A problem generally associated with orifice spray techniques, but more particularly with airless spray and air-assisted airless spray, is entrapment of fine air bubbles within the coating during application, which produces an inferior coating. It is particularly troublesome in clear coatings, because light reflected from the air bubbles gives the coating a white hazy appearance, but it is troublesome in pigmented coatings as well. The bubbles cause poor coating appearance, such as by distorting the surface, and cause poor coating performance, such as by decreasing corrosion protection and surface hardness. The bubbles may also become exposed through the surface due to surface wear from sanding or buffing operations and thereby render the coating unacceptable. In baked coatings, the bubbles serve as nucleation sights for solvent evaporation during baking and thereby can cause severe solvent popping in the coating. Sometimes, during heating, the bubbles expand and migrate to the surface, but in doing so they often form craters and tiny pits in the coating surface. This reduces coating gloss and distinctness of reflected image.

Without wishing to be bound by theory, air entrapment during spray application of a coating is believed to occur by more than one mechanism, depending upon the properties of the spray and coating. One mechanism is a high velocity droplet penetrating into the coating interior and forming a channel filled with air; the air becomes trapped in the coating film when the coating surface flows together or another droplet is deposited on top of it. This is consistent with the observation that sometimes air entrapment does not occur during application until the coating reaches a certain thickness. A coating with low viscosity would be expected to be susceptible to air entrapment by this mechanism. Higher coating viscosity would be expected to reduce droplet penetration, but the viscosity must remain low enough for rapid reflow to give a smooth coating. Another mechanism would be expected to occur with highly viscous coatings or with coatings that wet the substrate surface poorly. Under these conditions, the droplets tend to remain spherical for a period of time after impact instead of immediately spreading out and coalescing with their neighbors. Therefore, the droplets stack on top of each other and air becomes trapped in void spaces between them. This would also be expected to occur with normal viscosity coatings when droplets are deposited very rapidly on top of each other. This is consistent with the observation that air entrapment often occurs more readily when the spray builds up coating thickness very rapidly, such as when the traverse speed is low or the spray is very concentrated. Air entrapment sometimes occurs in streaks from concentrated portions of a non-uniform spray, which would be expected to create a churning action that would entrap air.

Entrapped air bubbles in a coating are generally smaller than the spray droplets that deposit the coating. Typically they are individual spherical air bubbles that lie in the interior of the coating film. Generally they have a diameter less than about 30 microns, although larger bubbles can also occur, particularly in thick coatings. The bubbles can be seen individually through a microscope or collectively by the hazy appearance that they give to a clear coating.

Miyamoto, in U.S. Pat. No. 4,842,900, issued Jun. 27, 1989, discloses a method and apparatus for using curtain coating or extrusion coating to apply a liquid film of a coating composition onto a traveling web in manufacturing photographic film, photographic printing paper, magnetic recording tape, adhesive tape, pressure sensitive recording paper, offset paper, and the like. The liquid film is formed by causing coating composition to flow in a single layer or a plurality of layers out of a die through a slit or slits. Just before the liquid film contacts the traveling web, the air entrained with the web is replaced by a gas which is highly soluble in the coating composition. The preferred gas is carbon dioxide. The speed of the traveling web can be significantly increased because the entrained bubbles of soluble gas are dissolved in the time of one-hundredth of a second or less. In the example disclosed therein, the speed of the traveling web was increased from 65 to 200 meters per minute.

Prior to the present invention, there has been no effective way to remove entrapped bubbles from a spray applied coating other than to try to promote their migration to the surface, followed by breakage of the surfaced bubble. To this end, various surface active agents or surfactants have been used in coating formulations, as is well known to those skilled in the art. But these surface active agents, which function effectively as defoamers in breaking foams and surface bubbles, and which also aid surface flow to prevent cratering, have proven to have limited effectiveness as air release agents, that is, in promoting migration of entrapped bubbles through the interior of the coating to the coating surface and thereby eliminating the air entrapment problem. The effectiveness of the surface active agent is also highly dependent upon properly matching the properties of the agents with the properties of the coating formulation, which usually must be determined by trial and error. Because many different surface active agents have been developed, this can be a time consuming and costly process, particularly if several coatings are applied, such as on a paint line where color change is employed. Moreover, because surface active agents are used to treat a variety of coating application problems, such as wetting, cratering, fisheyes, foaming, and pigment dispersion, the appropriate amount of surface active agent for one problem is often not the proper amount for another problem, so a compromise amount must be used. Therefore, it is desirable to remove air entrapment as a problem to be treated using surface active agents so that other problems may be more effectively treated. Furthermore, as aforementioned, migration of bubbles to the surface often leaves tiny pits on the hardened coating, which greatly reduces coating quality such as by reducing gloss and distinctness of reflected image.

Due to the high viscosity coating compositions that are typically utilized in the inventions described in the aforementioned related patents and patent application, air entrapment may be particularly noticeable. Specifically, prior to the inventions described in the aforementioned related patents and patent application, the liquid spray application of coatings, such as paints, lacquers, enamels, and varnishes, was effected solely through the use of organic solvents as viscosity reduction diluents. However, because of increased environmental concern, efforts have been directed to reducing the pollution from coating operations. Therefore, great emphasis has been placed on the development of new coating technologies that diminish the emission of organic solvent vapors.

Such a new coating technology is discussed in the aforementioned related patents and patent application, particularly U.S. Pat. No. 4,923,720, which teach, among other things, the utilization of supercritical fluids or subcritical compressed fluids, such as carbon dioxide or nitrous oxide, as viscosity reducing diluents in highly viscous organic solvent-borne coating compositions and/or highly viscous non-aqueous dispersions coating compositions to dilute these coatings to application viscosity required for liquid spray techniques.

As used herein, it will be understood that a "supercritical fluid" is a material which is at a temperature and pressure such that it is at, above, or slightly below its "critical point". As used herein, the "critical point" is the transition point at which the liquid and gaseous states of a substance merge into each other and represents the combination of the critical temperature and critical pressure for a given substance. The "critical temperature", as used herein, is defined as the temperature above which a gas cannot be liquified by an increase in pressure. The "critical pressure", as used herein, is defined as that pressure which is just sufficient to cause the appearance of two phases at the critical temperature.

As used herein, a "compressed fluid" is a fluid which may be in its gaseous state, its liquid state, or a combination thereof depending upon the particular temperature and pressure to which it is subjected upon admixture with the composition that is to have its viscosity reduced and the vapor pressure of the fluid at that particular temperature, but which is in its gaseous state at standard conditions of 0° C. and one atmosphere pressure (STP). The compressed fluid may comprise a supercritical or subcritical fluid.

As used herein, the phrases "coating composition", "coating material", and "coating formulation" are understood to mean conventional coating compositions, materials, and formulations that have no supercritical fluid or subcritical compressed fluid admixed therewith. Also as used herein, the phrases "spray mixture", "liquid mixture", and "admixed coating composition" are meant to include an admixture of a coating, coating material, coating composition, or coating formulation with at least one supercritical fluid or at least one subcritical compressed fluid.

As disclosed in the aforementioned patent applications, it has been discovered that supercritical fluids or subcritical compressed fluids are not only effective viscosity reducing diluents, but they can also remedy the defects of the airless spray process by creating vigorous decompressive atomization by a new airless spray atomization mechanism, which can produce the fine droplet size and feathered spray needed to apply high quality coatings.

In the spray application of coatings using supercritical fluids or subcritical compressed fluids such as carbon dioxide, the large concentration of carbon dioxide dissolved in the coating composition produces a liquid spray mixture that has markedly different properties than conventional coating compositions. In particular, the spray mixture is highly compressible, that is, the density changes markedly with changes in pressure, whereas conventional coating compositions are incompressible liquids when they are sprayed.

Without wishing to be bound by theory, it is believed that vigorous decompressive atomization can be produced by the dissolved carbon dioxide suddenly becoming exceedingly supersaturated as the spray mixture leaves the nozzle and experiences a sudden and large drop in pressure. This creates a very large driving force for gasification of the carbon dioxide, which overwhelms the cohesion, surface tension, and viscous forces that oppose atomization and normally bind the fluid flow together into a fishtail type of spray.

A different atomization mechanism is evident because atomization occurs right at the spray orifice instead of away from it as is conventional. Atomization is believed to be due not to the break-up of the liquid film from shear with the surrounding air but, instead, to the expansive forces of the compressible spray solution created by the carbon dioxide. Therefore, no liquid film is visible coming out of the nozzle.

Furthermore, because the spray is no longer bound by cohesion and surface tension forces, it leaves the nozzle at a much wider angle than normal airless sprays and produces a "feathered" spray with tapered edges like an air spray. This produces a rounded, parabolic-shaped spray fan instead of the sharp angular fans typical of conventional airless sprays. The spray also typically has a much wider fan width than conventional airless sprays produced by the same spray tip. As used herein, the terms "decompressive atomization" and "decompressive spray" each refer to a spray, spray fan, or spray pattern that has the preceding characteristics.

Laser light scattering measurements and comparative spray tests show that decompressive atomization can produce fine droplets that are in the same size range as air spray systems instead of the coarse droplets produced by normal airless sprays. These fine droplets are ideal for minimizing orange peel and other surface defects commonly associated with spray application. This fine particle size provides ample surface area for the dissolved carbon dioxide to very rapidly diffuse from the droplets within a short distance from the spray nozzle. Therefore, the coating contains little dissolved carbon dioxide when it is deposited onto the substrate.

As disclosed in the aforementioned patent applications, coating compositions formulated for spraying with supercritical fluids or subcritical compressed fluids, called coating concentrates, have much less organic solvent content than conventional coatings, in order to reduce air pollution, but typically utilize relatively high molecular weight polymers. Consequently, the coating concentrates have a high viscosity, typically 800 to 3000 centipoise at a temperature of 25° Celsius and atmospheric pressure, which is much higher than normal coating compositions. Because the coating concentrate is applied to the substrate with little dissolved supercritical fluid or subcritical compressed fluid, which is released as gas from the droplets in the spray, the coating is deposited on the substrate with a viscosity that is the same or higher than that of the coating concentrate. This often enables the coating to be applied to final thickness in one application without running or sagging. Therefore, because of the higher coating viscosity, migration of entrapped air bubbles to the surface of the coating is usually much less effective than in conventional coatings.

In contrast, even conventional high-solids coatings have a viscosity that is not much higher than that of low-solids coatings. Typically, high-solids clear coats have viscosities of about 80 centipoise and base coats have viscosities of about 35 centipoise, both at a temperature of 25° Celsius. Even after solvent is lost in the spray, conventional low-solids and high-solids coatings are typically deposited onto the substrate with considerably lower viscosity than the coating concentrates. With conventional low-solids coatings, the coating usually must be applied in several layers to allow excess atomization solvent to evaporate between layers to avoid running and sagging. Conventional high-solids coatings likewise have relatively low deposition viscosity, as evident by the running and sagging problem caused by the low molecular weight polymers used to obtain low atomization viscosity with less solvent.

For these reasons, there is clearly a need for new liquid spray technology that significantly prevents or minimizes air entrapment in coatings. The new technology should generally be applicable to orifice sprays, be applicable to a wide variety of coating formulations and coating materials, be readily implemented, and be environmentally compatible. In particular, it should be compatible with and augment new orifice spray processes that have been developed to use coatings with much less solvent and air toxic materials than conventional coatings and spray processes, in order to significantly reduce air pollution and worker exposure to toxic solvents.

SUMMARY OF THE INVENTION

By virtue of the present invention, methods and apparatus have been discovered which are able to accomplish the above noted objectives. Thus, the methods of the present invention are able to significantly prevent or minimize the occurrence of entrapped non-soluble gaseous bubbles, particularly air bubbles, in a wide variety of coatings applied by orifice sprays such as air spray, airless spray, and air-assisted airless spray. In a preferred embodiment, the methods are applicable to viscous high-solids coatings that contain much less solvent and air toxics than conventional coatings which are applied by using supercritical fluids or subcritical compressed fluids such as supercritical carbon dioxide as a diluent.

More particularly, the method of the present invention involves a totally new approach to the removal of entrapped non-soluble gaseous bubbles from coatings, which involves spray applying the coating onto a substrate in an atmosphere consisting of gases having appreciable solubility in the applied coating, such that any gas bubbles that may become entrapped in the coating are removed after application by the gases dissolving into the coating and thereafter diffusing to the surface where they escape. This is in contrast to insoluble air bubbles which are removed substantially only by the mechanism of migration to the surface. Consequently, entrapment of non-soluble gaseous materials, such as air, can significantly be reduced or eliminated without the need to specially treat the coating formulation with surface active air release agents as has been done in the prior art. This eliminates an extra coating formulation step as well as an expensive component. Most importantly, by carrying out the spraying of the coating composition in an atmosphere containing gases which are appreciably soluble in the coating, instead of air which is generally insoluble, higher quality coatings are produced by avoiding the pitting that often results from migration of air bubbles to the surface.

Accordingly, in one embodiment, the present invention is directed to a method for preventing or minimizing entrapped non-soluble gaseous bubbles, particularly air bubbles, in a coating applied to a substrate by a liquid spray, which comprises:

a) forming a liquid coating composition containing at least one polymeric compound capable of forming a coating on a substrate;

b) spraying said liquid coating composition onto a substrate in a first atmosphere to form a liquid coating thereon, said first atmosphere comprising one or more soluble gases having a solubility in said liquid coating of at least 0.1 weight percent, based on the total weight of the liquid coating, at one atmosphere partial pressure and at the ambient temperature of the substrate; and c) subjecting the substrate with said liquid coating thereon to a second atmosphere comprising said one or more soluble gases in a lower concentration than in the first atmosphere.

In another embodiment of the present invention, an apparatus is disclosed for preventing or minimizing entrapped non-soluble gaseous bubbles, particularly air bubbles, in a coating applied to a substrate by a liquid spray, which comprises:

a) means for supplying at least one liquid coating composition containing at least one polymeric compound capable of forming a coating on a substrate;

b) means for supplying at least one substrate;

c) means for spray applying the at least one liquid coating composition onto the substrate to form a liquid coating thereon;

d) means for providing a first atmosphere within which said spray is applied to said at least one substrate comprising one or more soluble gases having a solubility of at least 0.1 weight percent in said liquid coating, based on the total weight of the liquid coating, at one atmosphere partial pressure and at the ambient temperature of the substrate; and e) means for subjecting the substrate containing the liquid coating to a second atmosphere comprising said one or more soluble gases in a lower concentration than in the first atmosphere.

DETAILED DESCRIPTION OF THE INVENTION

Figure 1:
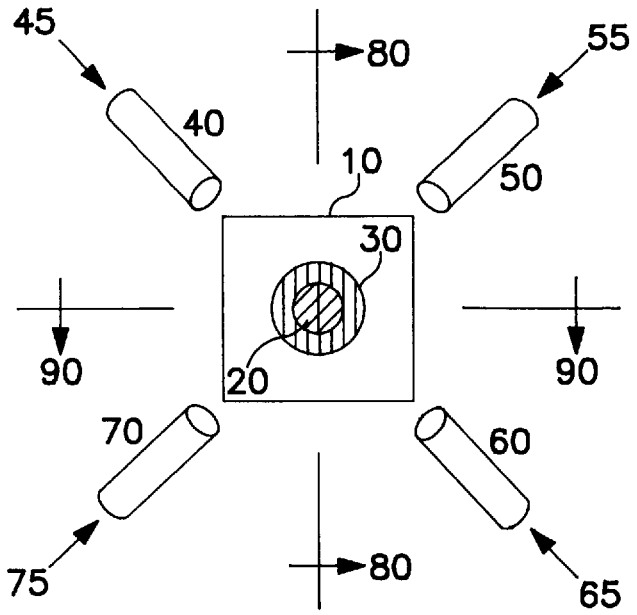
FIG. 1 is an end-view schematic diagram of a tubular distribution system for providing soluble gas to a spray that can be used in the practice of the present invention.

It has been found that by using the methods and apparatus of the present invention, coatings can be applied to substrates by liquid sprays such that entrapment of non- soluble gaseous bubbles, particularly air bubbles, in the final coatings are significantly prevented or minimized, thereby producing coatings with improved appearance and performance. Preferably, this is accomplished by spray applying a liquid coating in a first atmosphere consisting essentially of one or more gases having appreciable solubility in the coating, such as carbon dioxide, nitrous oxide, ethane, or propane, so that bubbles entrapped in the coating substantially contain soluble gases and not an insoluble gas such as air, and then removing the soluble gas first atmosphere from contact with the applied liquid coating soon after deposition and replacing it with a second atmosphere having a lower concentration of the soluble gases, such as fresh air, so that the soluble gases within the entrapped bubbles dissolve into the coating and diffuse to the coating surface and ultimately escape into the second atmosphere, thereby significantly reducing the number and/or size of entrapped bubbles in the final coating.

As used herein, it will be understood that a "soluble gas" is a material that is a gas when at standard conditions of 0° C. temperature and one atmosphere pressure (STP) and has a solubility in the applied liquid coating of at least 0.1 weight percent when at one atmosphere partial pressure and the ambient temperature of the substrate. In order to avoid condensation of the soluble gas if the spray or substrate should subcool below ambient temperature, such as from expansion of the soluble gas or another gas in the spray, the soluble gas should not have a boiling point close to the ambient temperature of the substrate. Droplets of condensed soluble gas deposited in the coating, because of their much greater density than gas bubbles, could cause inhomogeneity in the coating film and imperfections in the surface when the condensed gas revaporizes when warmed. Soluble gas condensed on the substrate during deposition could adversely affect adhesion of the coating. Therefore, the soluble gas desirably has a normal boiling point below about 0° C. The soluble gas also desirably has a critical temperature above about 0° C. to have appreciable solubility.

Soluble gases that are applicable for use in the present invention include carbon dioxide, nitrous oxide, ethane, ethylene, propane, propylene, butane, isobutane, ammonia, dimethyl ether, xenon, and acetylene, or mixtures thereof, but are not limited to these materials. The normal boiling points and critical temperatures of these gases are given in Table 1.

TABLE 1

EXAMPLES OF SOLUBLE GASES

| Soluble Gas | Boiling Point (° C.) | Critical Temperature (° C.) |
|---|---|---|
| Carbon Dioxide | −78.5 | 31.3 |
| Nitrous Oxide | −88.6 | 36.5 |
| Ethane | −88.0 | 32.3 |
| Ethylene | −103.7 | 9.2 |
| Propane | −42.1 | 96.7 |
| Propylene | −47.7 | 92.0 |
| Butane | −0.5 | 152.0 |
| Isobutane | −11.8 | 135.0 |
| Ammonia | −33.4 | 132.4 |
| Dimethyl Ether | −24.8 | 126.9 |
| Xenon | −108.2 | 16.6 |
| Acetylene | −84.0 | 36.3 |

Preferably, the soluble gas has a solubility in the applied liquid coating of at least about 0.2 weight percent, based on the total weight of the applied liquid coating, when at one atmosphere partial pressure and the ambient temperature of the substrate. More preferably, the soluble gas has a solubility in the coating of about 0.4 weight percent to about 20 weight percent, on the same basis. Table 2 gives examples of solubilities of soluble gases in some common coating solvents at ambient temperatures of 20 to 25° C. when the soluble gas is at a partial pressure of about one atmosphere (from Gerrard, W., Gas Solubilities, Pergamon Press, 1980, and Solubility of Gases and Liquids, Plenum Press, 1976.)

TABLE 2

WEIGHT-PERCENT SOLUBILITY OF SOLUBLE GASES IN SOLVENTS AT ONE ATMOSPHERE PARTIAL PRESSURE

| Weight Percent | Gas | Solvent |
|---|---|---|
| .813 | Carbon Dioxide | Methanol |
| .660 | Carbon Dioxide | Ethanol |
| .426 | Carbon Dioxide | Pentanol |
| 1.583 | Carbon Dioxide | Acetone |
| 1.240 | Carbon Dioxide | Methyl Acetate |
| 1.009 | Carbon Dioxide | Butyl Acetate |
| .929 | Carbon Dioxide | Pentyl Acetate |
| 1.597 | Carbon Dioxide | Diethyl Ether |
| .563 | Carbon Dioxide | Pentane |
| .156 | Carbon Dioxide | Water |
| .741 | Nitrous Oxide | Methanol |
| .670 | Nitrous Oxide | Ethanol |
| 1.217 | Nitrous Oxide | Acetone |
| 1.065 | Nitrous Oxide | Methyl Acetate |
| 1.052 | Nitrous Oxide | Pentyl Acetate |
| 1.193 | Nitrous Oxide | Pentane |
| .110 | Nitrous Oxide | Water |
| .368 | Ethane | Methanol |
| .435 | Ethane | Ethanol |
| .443 | Ethane | Propanol |
| .441 | Ethane | Butanol |
| .427 | Ethane | Pentanol |
| .506 | Ethane | Toluene |
| .454 | Ethylene | Toluene |
| .677 | Ethylene | Hexane |
| .88 | Propane | Benzyl Alcohol |
| 2.67 | Propane | n-Octanol |
| 2.26 | Propane | Toluene |
| 6.24 | Propane | Hexane |
| 17.4 | Butane | n-Octanol |
| 12.7 | Dimethyl Ether | Acetone |
| .67 | Xenon | Nitrobenzene |
| 2.32 | Xenon | Toluene |
| 4.42 | Xenon | Hexane |

Surprisingly, carbon dioxide has been found to have appreciable solubility in a variety of coating compositions having a relatively high content of polymer solids and therefore a low content of solvent. Measured carbon dioxide solubilities at ambient temperature and about one atmosphere partial pressure in various coating compositions with high polymer contents are given in Table 3 for some thermosetting acrylic polymer coatings, in Table 4 for some thermosetting polyester polymer coatings, in Table 5 for some thermoplastic polymer coatings, and in Table 6 for an air-dry alkyd polymer coating. The solubilities range from 0.34 to 0.71 weight percent of the coating composition for polymer solids contents that range up to 73% for these compositions.

TABLE 3

CARBON DIOXIDE SOLUBILITY IN THERMOSETTING ACRYLIC COATINGS

| Composition | | | |
|---|---|---|---|
| #1 | #2 | #3 | Components |
| 37.5% | 27.8% | 28.4% | Acryloid AT-400 acrylic polymer |
| 12.6% | 9.3% | 9.5% | Acryloid AT-954 acrylic polymer |
| 16.7% | 12.4% | 12.6% | Cymel 323 melamine polymer |
| 16.9% | 38.2% | 13.0% | methyl amyl ketone |
| 0.0% | 0.0% | 24.3% | xylene |
| 6.8% | 5.1% | 5.2% | ethyl 3-ethoxypropionate |
| 4.8% | 3.6% | 3.6% | n-butanol |
| 4.2% | 3.1% | 3.1% | isobutanol |
| 0.5% | 0.5% | 0.3% | surfactant in xylene |
| 100.0% | 100.0% | 100.0% | Total |
| 66.8% | 49.5% | 50.5% | Polymer solids content |
| 21.0 | 24.0 | 23.6 | Ambient Temperature, C. |
| 14.5 | 15.0 | 15.0 | Partial Pressure, psia |
| .358 | .415 | .365 | Solubility, weight percent |

TABLE 4

CARBON DIOXIDE SOLUBILITY IN THERMOSETTING POLYESTER COATINGS

| Composition | | |
|---|---|---|
| #4 | #5 | Components |
| 54.7% | 50.5% | polyester polymer |
| 18.2% | 16.8% | Cymel 323 polymer |
| 13.7% | 12.6% | methyl PROPASOL acetate |
| 0.0% | 12.9% | butyl CELLOSOLVE acetate |
| 4.6% | 4.2% | isobutanol |
| 2.8% | 2.6% | n-butanol |
| 2.8% | 0.0% | ethyl 3-ethoxypropionate |
| 2.7% | 0.0% | methyl amyl ketone |
| 0.5% | 0.4% | surfactant in xylene |
| 100.0% | 100.0% | Total |
| 72.9% | 67.3% | Polymer solids content |
| 23.1 | 27.1 | Ambient Temperature, C. |
| 14.8 | 15.2 | Partial Pressure, psia |
| .394 | .338 | Solubility, weight percent |

TABLE 5

CARBON DIOXIDE SOLUBILITY IN THERMOPLASTIC COATINGS

| Composition | | |
|---|---|---|
| #6 | #7 | Components |
| 44.0% | 0.0% | Acryloid B-66 polymer |
| 0.0% | 30.0% | cellulose acetate butyrate |
| 56.0% | 42.0% | methyl amyl ketone |
| 0.0% | 28.0% | methyl ethyl ketone |
| 100.0% | 100.0% | Total |
| 44.0% | 30.0% | Polymer solids content |
| 27.0 | 23.7 | Ambient Temperature, C. |
| 15.1 | 15.0 | Partial Pressure, psia |
| .578 | .709 | Solubility, weight percent |

TABLE 6

CARBON DIOXIDE SOLUBILITY IN AIR-DRY ALKYD COATING

| Composition #8 | Components |
|---|---|
| 26.2% | alkyd resin |
| 13.9% | soda alkyd resin |
| 7.7% | acrylic resin |
| 3.6% | polyester resin |
| 22.0% | xylene |
| 15.2% | mineral spirits |
| 4.2% | methyl amyl ketone |
| 4.2% | methyl isobutyl ketone |
| 1.5% | n-butyl propionate |
| 1.5% | n-pentyl propionate |
| 100.0% | Total |
| 51.4% | Polymer solids content |
| 24.2 | Ambient Temperature, C. |
| 15.0 | Partial Pressure, psia |
| .384 | Solubility, weight percent |

As used herein, it will be understood that a "non- soluble gas" is a gas that has a solubility in the liquid coating below 0.1 weight percent when at one atmosphere partial pressure and at the ambient temperature of the substrate, and therefore is unsuitable for use as a soluble gas in the present invention. Examples of gases that are generally non-soluble in applied liquid coatings are air, nitrogen, oxygen, hydrogen, methane, argon, and helium. Table 7 gives examples of solubilities of non-soluble gases in some common coating solvents at ambient temperature and a partial pressure of about one atmosphere (from Gerrard, W., Gas Solubilities, Pergamon Press, 1980, and Solubility of Gases and Liquids, Plenum Press, 1976.)

TABLE 7

WEIGHT-PERCENT SOLUBILITY OF NON-SOLUBLE GASES IN SOLVENTS AT ONE ATMOSPHERE PARTIAL PRESSURE

| Weight Percent | Gas | Solvent |
|---|---|---|
| .023 | Nitrogen | Methanol |
| .021 | Nitrogen | Ethanol |
| .018 | Nitrogen | Butanol |
| .014 | Nitrogen | Hexane |
| .047 | Nitrogen | Diethyl Ether |
| .030 | Oxygen | Methyl Acetate |
| .031 | Oxygen | Hexane |
| .083 | Oxygen | Diethyl Ether |
| .0010 | Hydrogen | Ethanol |
| .0005 | Hydrogen | Acetone |
| .0005 | Hydrogen | Hexane |
| .0017 | Hydrogen | Diethyl Ether |
| .0007 | Hydrogen | Pentyl Acetate |
| .044 | Methane | Methanol |
| .046 | Methane | Ethanol |
| .052 | Methane | Acetone |
| .002 | Methane | Water |
| .057 | Argon | Methanol |
| .061 | Argon | Acetone |
| .070 | Argon | Cyclohexane |
| .007 | Argon | Water |

Preferably, the soluble gases used in the present invention, in addition to having appreciable solubility in the coating, have low toxicity and are odorless, are not adversely reactive with the coating, and are inexpensive and readily available in bulk quantity. The soluble gas desirably has molecules that are small and linear so that they will readily diffuse through the coating from the entrapped bubbles to the surface. So too, the soluble gas is environmentally compatible, can be made environmentally compatible by treatment, or can be readily recovered from the spray environment. For example, carbon dioxide is environmentally compatible. Nitrous oxide becomes environmentally compatible by natural decomposition in the environment to molecular nitrogen and oxygen or it can be thermally decomposed by heating the spray effluent. Ethane, propane, and butane can be made environmentally compatible by incineration to carbon dioxide and water. Ammonia is highly soluble in water and can be recovered from the spray effluent by absorption methods such as a water scrubber. Other methods can also be used such as adsorption.

Preferable soluble gases for use in the present invention are carbon dioxide, nitrous oxide, ethane, propane, and butane, or mixtures thereof. Preferable mixtures of the soluble gases are mixtures that: (1) are significantly less flammable than ethane, propane, and butane by themselves or in combination, and (2) have significantly higher solubility in the coating than carbon dioxide and nitrous oxide by themselves or in combination. For example, a mixture of 70% carbon dioxide and 30% propane would have significantly higher solubility than carbon dioxide by itself yet would be significantly less flammable than propane by itself.

More preferably, the soluble gases used in the present invention are non-flammable and are environmentally compatible when discharged directly into the environment. Such soluble gases include carbon dioxide, nitrous oxide, or mixtures thereof. The most preferred soluble gas for use in the present invention is carbon dioxide because of its low cost, wide availability in bulk quantity, environmental compatibility, low toxicity, non-flammability, stability, and appreciable solubility in coatings; because it has small linear molecules that readily diffuse through coatings; and because it is readily used as a supercritical fluid or subcritical compressed fluid diluent in the spray application of low-pollution coatings. However, use of any of the aforementioned soluble gases and mixtures thereof are to be considered within the scope of the present invention.

When the liquid coating is applied onto the substrate while the spray and substrate are within the first atmosphere, the one or more soluble gases contained in such first atmosphere should desirably, although not necessarily, comprise the predominate portion of gases in such atmosphere within the interior of the spray. It will be appreciated from the above discussion that even a small portion of soluble gases contained in the first atmosphere will help alleviate the problem of entrapped non-soluble gases in the coating. The greater the concentration of such soluble gases in the first atmosphere, the lower the concentration of non-soluble gases there will be in the entrapped gaseous bubbles. Hence, it is most preferable that the first atmosphere be made entirely of the soluble gases so as to obtain the maximum benefit of the present invention. Alternatively, it is desirable to have a predominate portion of such first atmosphere contain the soluble gases, say from about 60 to about 100 percent by volume, more preferably, from about 80 to about 100 percent by volume, still more preferably from about 90 to about 100 percent by volume. Nevertheless, however, even a small portion of such soluble gases may also be helpful, say from about 30 to about 60 percent by volume.

In order to help the diffusion of the soluble gases through the applied liquid coating so that it can escape, the second atmosphere to which the substrate having the liquid coating thereon is subjected desirably contains as little of such soluble gases as possible. The difference in concentration of such soluble gases between that which is present in the liquid coating and the second atmosphere creates a concentration gradient and thereby helps drive the diffusion of the soluble gases through the coating and into the second atmosphere. Most preferably, the second atmosphere is substantially totally devoid of such soluble gases. Desirably, the second atmosphere contains a very low concentration of such soluble gases, typically less than about 5 mole percent, based on the total content of soluble gases and non-soluble gases in the second atmosphere. However, even if the second atmosphere merely contains a lesser concentration of the soluble gases than is found in the first atmosphere, such is enough to help the diffusion process. Generally, air may be used as the second atmosphere.

The method of forming the first atmosphere comprising one or more soluble gases is not critical to the present invention provided that the method effectively supplies soluble gas to the interior of the spray. One method is for the spray application to be carried out in a closed system filled entirely with the first atmosphere of soluble gas. After spray application, the coated substrate is then subjected to the second atmosphere containing soluble gas in substantially lower concentration, either by purging the closed system of the first atmosphere and replacing it with the second atmosphere, or by removing the coated substrate from the closed system to an environment containing the second atmosphere, such as air. For example, the closed system may be a small spray booth filled with the first atmosphere of soluble gas instead of air. The substrate is conveyed into the spray booth, wherein the liquid coating is applied in the first atmosphere, and then the coated substrate is conveyed outside the spray booth into the second atmosphere consisting of air.

Surprisingly, we have discovered that it is not necessary for the spray application to be carried out in a closed system filled entirely and exclusively with the first atmosphere of soluble gas. Instead, we have discovered that an open system may be utilized in which the first atmosphere is supplied locally in the vicinity of the spray, provided that such first atmosphere is effectively provided into the interior of the spray. Therefore, conventional air-flow spray booths may be utilized provided that a sufficient flow of the first atmosphere, such as carbon dioxide gas, is supplied locally to the spray. Thus, when the spray impacts the substrate, the first atmosphere is supplied locally to the substrate by the spray itself as the coating is deposited. Desirably, the spray droplets in the interior of the spray, which have the highest velocity and flux rate and usually contribute the most to bubble entrapment, are immersed in the highest concentration of soluble gases.

To ensure that the first atmosphere is effectively provided into the interior of the spray, it is most desirable for the first atmosphere to be supplied to the spray in such a manner that the spray emerges from the spray orifice within said first atmosphere and also that atomization occurs within said first atmosphere. It is furthermore desirable that the first atmosphere be supplied adjacent to the spray in such manner that the first atmosphere is entrained into the forming and formed spray so as to minimize entrainment of non-soluble gases from the open environment, such as the surrounding air.

Accordingly, in one embodiment of the present invention, pressurized soluble gas is supplied to the spray gun and the first atmosphere is created by using the soluble gas as the atomization gas and preferably also as the shaping gas, instead of air, with sprays that are formed using compressed gas, such as an air spray gun or a high- volume, low-pressure air spray gun (HVLP). The present invention may likewise be used with sprays that are formed by gas-assisted airless atomization, such as an air-assisted airless spray gun, by supplying pressurized soluble gas to the spray gun and creating the first, atmosphere by using the soluble gas as the atomization and/or shaping gas, instead of air.

In another embodiment, the present invention may be used with airless sprays formed by passing the coating formulation under, pressure through an orifice, such as an airless spray gun, by supplying soluble gas to the spray to thereby form the first atmosphere in which the airless spray is formed. The present invention is particularly suitable for use with airless sprays of the aforementioned related patents and patent application, preferably a decompressive spray, wherein the supercritical or subcritical compressed fluid comprises a soluble gas that is dissolved in the spray mixture. Rapid expansion and gasification of the large concentration of dissolved compressed fluid during depressurization has been discovered to be very effective in providing the first atmosphere of soluble gas to the interior of the spray thus formed. Preferably, a flow of soluble gas is provided as the spray is being formed and adjacent to the formed spray such that the soluble gas is entrained into the forming and formed spray, thereby minimizing entrainment of non-soluble gases from the open environment, such as the surrounding air. The spray is thereby provided with a first atmosphere that desirably contains a high concentration of soluble gases and a low concentration of non-soluble gases.

More specifically, the one or more soluble gases may be provided to the airless spray by means of a conventional assist-gas feed system of an air-assisted airless spray gun, with the soluble gas being provided through the atomization gas ports and/or the shaping gas ports, instead of air, which is typically used for such purpose.

Figure 2:
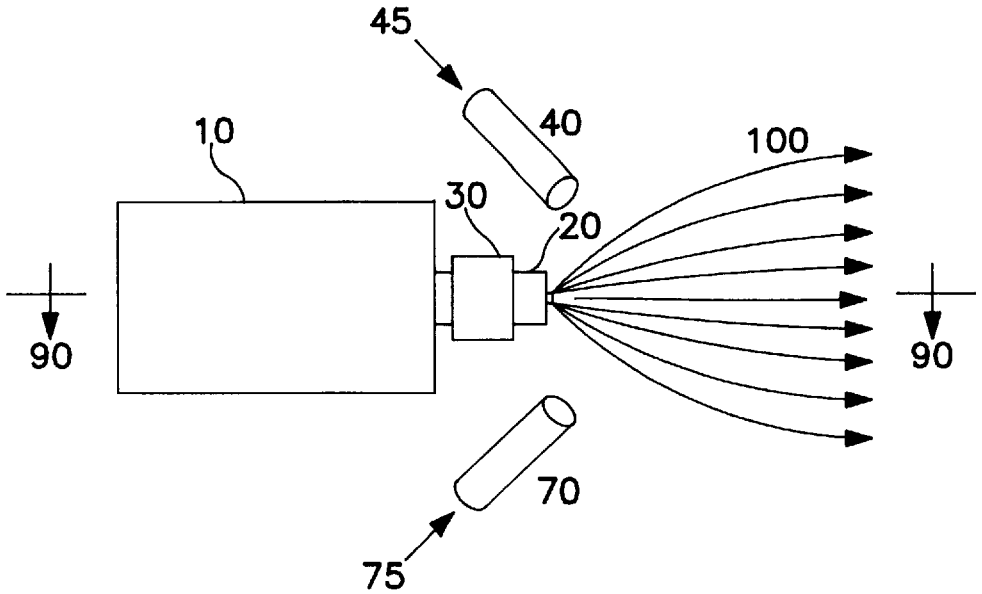
FIG. 2 is a side-view schematic diagram of the apparatus shown in FIG. 1 taken along line 80—80.
Figure 3:
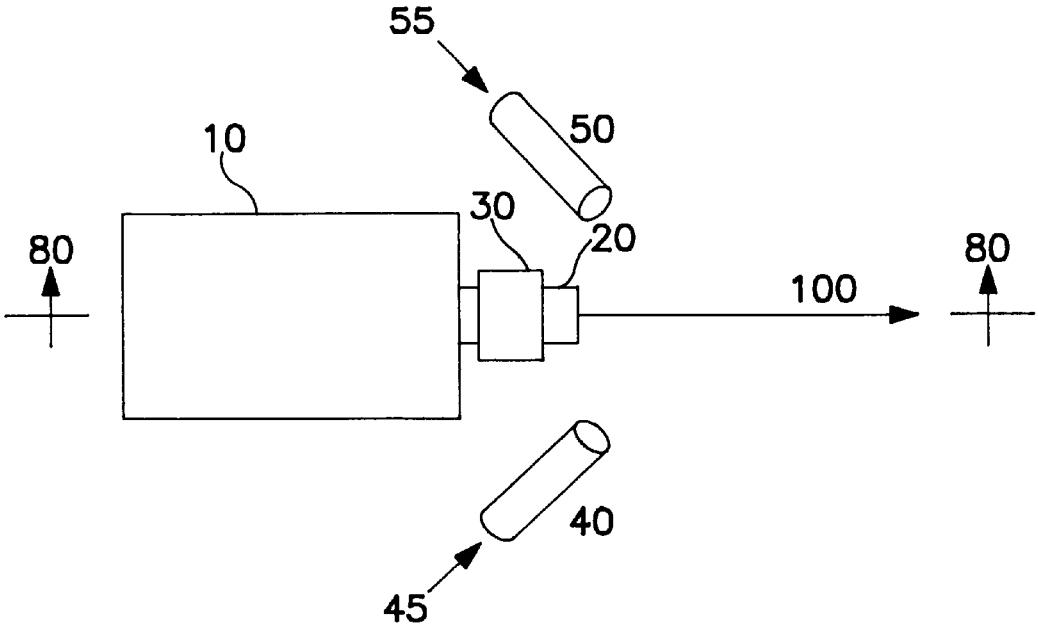
FIG. 3 is a top-view schematic diagram of the apparatus shown in FIG. 1 taken along line 90—90.

In general, the soluble gas may be provided to the spray, such as a conventional airless spray or a decompressive spray, to be entrained into the forming and formed spray, by a variety of means. One method is to distribute the soluble gas flow through a tubular distribution system that discharges the soluble gas flow symmetrically to the spray in the vicinity of the spray nozzle. For example, the distribution system may consist of four discharge tubes positioned with two outlets on each side of the spray fan in the vicinity of the spray orifice. One embodiment of such a system is illustrated in FIGS. 1, 2, and 3, which show the end view, side view, and top view, respectively, of the apparatus. Spray gun 10 has spray tip 20 attached to it by retaining nut 30. Discharge tubes 40, 50, 60, and 70, which may be ¼-inch diameter tubes, are positioned with the outlets being at a distance of about one inch outward from the plane of the spray fan and about one inch above and below the spray centerline. Only the end portion of each tube is shown, with soluble gas flowing from a manifold (not shown) to each tube outlet in the direction shown by arrows 45, 55, 65, and 75. The soluble gas flow is discharged from the tubes symmetrically against spray 100 at an angle in the downstream direction of the spray. Of course, for a given spray, the position of the discharge outlets may be altered depending upon the shape and width of the spray fan, to better distribute the flow of soluble gas to the spray. Alternatively, the tubular system may consist of six tubes, with three on each side of the spray fan. On each side, one of the tubes is positioned at the centerline of the spray and the other two are positioned symmetrically above and below the center tube. The flow of soluble gas through the center outlets may be provided at a higher rate than through the outer outlets, because the spray flux is higher at the center. Other arrangements and number of tubes may also be used. Soluble gas is supplied to the distribution tubes at low pressure at the desired flow rate for the given spray. The distribution tubes, because they have relatively large diameter openings, discharge the soluble gas at lower velocity than the gas jets used in air spray guns or in air-assisted airless spray guns.

Preferably, the distribution system for the soluble gas flow includes means, such as a shield, to prevent or minimize flow of surrounding air into the soluble gas flow being provided to the spray in the vicinity of the spray nozzle.

Figure 4:
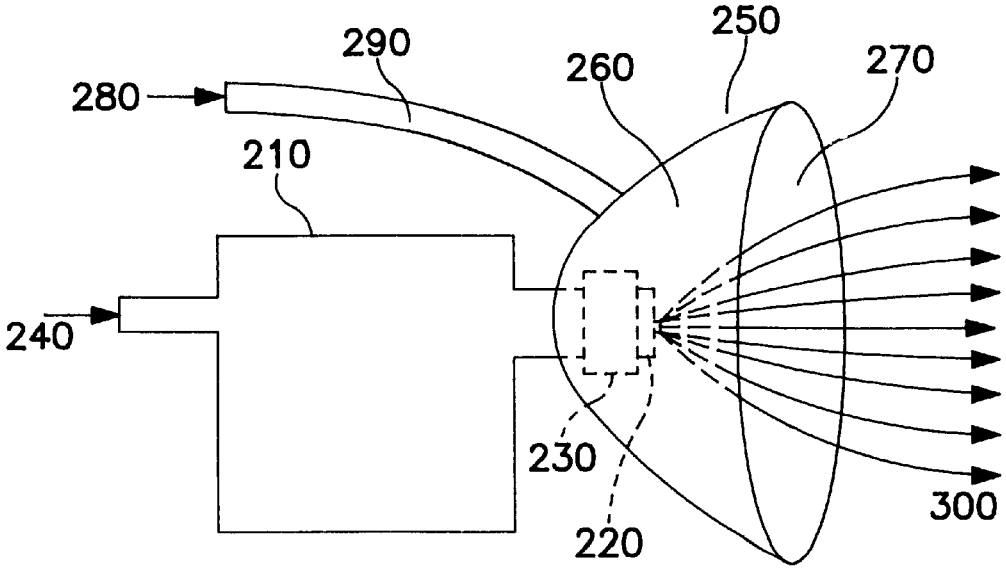
FIG. 4 is a schematic diagram of a shield and distributor plate system for providing soluble gas to a spray that can be used in the practice of the present invention.

One desirable means for providing soluble gas flow to the spray is a distributor plate that is positioned at the spray gun in such a manner that it partially encloses the forming spray. One embodiment of such a distributor plate is illustrated in FIG. 4. The distributor plate 250 has a convex exterior face 260, a hollow interior (not shown), and a concave porous or perforated interior face 270, which may have gas discharge nozzles attached to it, through which the soluble gas is discharged to spray 300. The distributor plate may be attached to spray gun 210 by suitable means (not shown) at the nozzle assembly, which includes spray tip 220 and retaining nut 230. Coating composition is supplied to the spray gun by suitable means (not shown) through inlet 240. The distributor plate is aligned with the spray and is preferably contoured to correspond to the shape, width, and thickness of the spray. The interior face may be spaced uniformly at a distance of from about 1 to about 3 inches from the sides and edges of the spray. The distributor plate may extend from about 1 to about 6 inches beyond the spray tip. Preferably, it extends from about 2 to about 4 inches beyond the spray tip. Soluble gas is supplied from supply 280, such as a pressurized cylinder (not shown), through inlet line 290. Means such as a pressure regulator or a control valve (not shown) are provided for adjusting and controlling the flow rate of soluble gas discharged to the spray. Means may be provided for measuring the flow rate of the soluble gas, such as a gas flow meter or a mass flow meter. The soluble gas flows from inlet 290 through the hollow interior of distributor plate 250 to the porous or perforated interior face 270, through which it is discharged to spray 300. The flow outlets on the interior face are preferably arranged and sized to distribute the soluble gas symmetrically and uniformly to the spray. The outlet face may discharge the soluble gas with the greatest flow rate being in the immediate vicinity of the nozzle, so that more soluble gas is entrained into the spray where the spray velocity and flux are greatest.

In general, the distributor plate is contoured to reduce or minimize entrainment of surrounding air into the soluble gas supplied to the forming spray. It is preferably shaped to both shield the spray from air flowing around the distributor plate and to minimize turbulent mixing between the soluble gas flow and the surrounding air flowing downstream from the distributor plate, such as is shown in FIG. 4. Most desirably, the distributor plate should keep surrounding air from flowing to the vicinity of the nozzle where the spray is formed.

The one or more soluble gases are supplied to the spray at a flow rate that is sufficiently high for the spray to be formed and applied to the substrate in a first atmosphere that contains the one or more soluble gases in a sufficiently high portion to help alleviate the problem of entrapped non-soluble gases in the coating. Preferably, the one or more soluble gases are supplied to the spray at a flow rate that is sufficiently high for the one or more soluble gases to comprise the predominate portion of the first atmosphere within the spray, especially within the interior of the spray. In general, the required flow rate of the one or more soluble gases is proportional to the flow rate at which the coating composition is sprayed, that is, a higher spray rate requires a higher flow rate of the one or more soluble gases into the spray. The required flow rate also generally depends upon how efficiently the one or more soluble gases are provided to the spray by the supply means, especially to the interior of the spray. Preferably, the one or more soluble gases is provided at higher flow rate to the central portion of the spray, to allow for the greater spray velocity and flux at the center.

The rapid expansion and gasification of dissolved compressed fluid that occurs in forming a decompressive spray may be a method for providing the first atmosphere of soluble gas to the interior of the spray. Therefore, by spraying a mixture of coating composition admixed with one or more soluble gases through an orifice, the problem of entrapment of non-soluble gases in the coating may be reduced by using relatively low flow rates of the one or more soluble gases in proportion to the flow rate of the coating composition sprayed. Surprisingly, with carbon dioxide as the soluble gas, for example, this has been found to be effective with about 0.3 grams of carbon dioxide admixed with about 1.0 gram of coating composition sprayed, for decompressive sprays that have low turbulence levels so that relatively little surrounding air is mixed into the interior of the spray. For sprays having higher turbulence levels, and hence higher levels of surrounding air mixed or entrained into the interior of the spray, an external flow of the one or more soluble gases is preferably provided to the forming spray and adjacent to the formed spray to minimize such mixing or entrainment of the surrounding air into the spray.

In general, when the one or more soluble gases are supplied by a distribution means which is positioned in close proximity to the spray orifice, such as the four discharge tubes shown in FIGS. 1–3, they are supplied to the spray to form the first atmosphere at a flow rate of at least about 0.3 grams of soluble gas per gram of coating composition. Preferably, the one or more soluble gases are supplied at a flow rate of about 0.4 to about 10 grams of soluble gas per gram of coating composition. More preferably, the one or more soluble gases are supplied at a flow rate of about 0.6 to about 5 grams of soluble gas per gram of coating composition. Most preferably, the one or more soluble gases are supplied at a flow rate of about 0.8 to about 3 grams of soluble gas per gram of coating composition.

The one or more soluble gases are preferably supplied at such temperature that the first atmosphere is at about ambient temperature. The one or more soluble gases may be heated if this is advantageous to the application.

In the spray application of the coating to the substrate, the distance from the orifice to the substrate is not critical to the practice of the present invention. Generally the substrate is sprayed from a distance of about 4 inches to about 24 inches. A distance of about 6 inches to about 20 inches is preferred. A distance of about 8 inches to about 16 inches is most preferred.

The present invention may be used to spray apply coatings to a variety of substrates, the choice of substrate not being critical in the practice of the present invention. Examples of suitable substrates include, but are not limited to, metal, wood, glass, plastic, paper, cloth, ceramic, masonry, stone, cement, asphalt, rubber, and composite materials.

The liquid spray comprises droplets which generally have an average diameter of one micron or greater. Preferably, these droplets have an average diameter of from about 5 to about 200 microns. More preferably, these droplets have an average diameter of from about 10 to about 100 microns. Most preferably, these droplets have an average diameter of from about 15 to about 50 microns. Small spray droplets are desirable to minimize the size of the gaseous bubbles entrapped in the coating, but the droplets are desirably large enough to be deposited efficiently onto the substrate.

The gaseous bubbles entrapped in the liquid coating spray applied to the substrate should generally have an average diameter of less than about 100 microns. Preferably, these bubbles have an average diameter of less than about 50 microns. More preferably, these bubbles have an average diameter of less than about 40 microns. Most preferably, these bubbles have an average diameter of from about 5 to about 30 microns. Smaller bubbles are desirable because they dissolve more quickly into the applied coating.

The liquid coating films applied to the substrate through the practice of the present invention should generally have a wet film thickness of less than about 10 mils. Preferably, the wet film thickness is from about 0.2 to about 8 mils. More preferably, the wet film thickness is from about 0.4 to about 6 mils. Most preferably, the wet film thickness is from about 0.8 to about 4 mils. Thinner coating films are desirable because they allow the one or more soluble gases to more quickly diffuse from the entrapped bubbles to the surface of the coating, where they are released into the second atmosphere having a low concentration of the soluble gases.

After the coating has been applied to the substrate, the substrate with the liquid coating thereon should generally be subjected to the second atmosphere comprising the one or more soluble gases in a substantially lower concentration than in the first atmosphere, within a time period that is suitable for the given coating and application. The time period should generally be significantly shorter than the time required for solvents to substantially evaporate from the coating, so that the one or more soluble gases can desirably diffuse from the entrapped gaseous bubbles while the coating is still fluid. Preferably, the coated substrate is subjected to the second atmosphere within a short period of time after deposition, typically within about 1 to about 3 minutes. Most preferably, the coating substrate is subjected to the second atmosphere immediately after deposition.

The coated substrate is preferably subjected to the second atmosphere until the one or more soluble gases have substantially diffused from the coating into the second atmosphere, thereby alleviating the problem of entrapped gaseous bubbles in the coating. The time required depends upon the thickness of the coating, the size of the entrapped gaseous bubbles, and the number of bubbles per unit area in the coating. Thicker coatings, larger bubbles, and a greater number of bubbles require a longer period of time. Typically, several minutes may be required. Because the soluble gas has higher diffusivity through the coating than the solvents, generally the soluble gas diffuses from the coating before the slow evaporating solvents have substantially diffused from the coating.

If curing of the coating composition present upon the coated substrate is required, it may be performed by means which are well known to those in the coatings art, such as allowing for evaporation of the solvent, application of heat or ultraviolet light, and the like.

The present invention may be used with conventional solvent-borne coatings, high solids coatings, and also coating concentrates, including liquid polymer systems, all of which, if desired, may be sprayed with supercritical or subcritical compressed fluids, such as carbon dioxide, acting as viscosity reducing diluents.

The polymeric compounds suitable as coating materials are any of the polymers known to those skilled in the coatings art. They may be thermoplastic materials, thermosetting materials, or crosslinkable film forming systems.

Suitable solvents for use in the coating compositions are also well known to those skilled in the coating art and include, but are not limited to: ketones; esters; ethers; glycol ethers; glycol ether esters; alcohols; aromatic hydrocarbons; halocarbons; nitroalkanes; and the like. Generally, solvents suitable for this invention desirably have solvency characteristics for the polymeric compounds and also have the proper balance of evaporation rates so as to insure good coating formation. Solvents in which the polymeric compounds have only limited solubility, such as lower hydrocarbon compounds, may be used as diluent solvents in combination with the solvents in which the polymeric compounds have high solubility. A review of the structural relationships important to the choice of solvent or solvent blend is given by Dileep et al., Industrial and Engineering Chemistry Product Research and Development 24, 162, 1985, and Francis, A. W., Journal of Physical Chemistry 58, 1099, 1954.

In addition to solvent-borne coatings, the present invention may also be used with water-borne or water-diluted coating compositions. Preferably such coating compositions contain a coupling solvent. A coupling solvent is a solvent in which the polymeric compound is at least partially soluble and, most importantly, is also at least partially miscible with water. The coupling solvent enables the miscibility of the polymeric compounds, the organic solvents, and the water to the extent that a single phase is desirably maintained such that the composition may optimally be sprayed and a good coating formed. Generally a significant fraction of the water evaporates in the spray, so the deposited coating has an increased level of coupling solvent and organic solvent, which desirably increases the solubility of the one or more soluble gases in the water- diluted coating. Furthermore, water-borne coatings are formulated so that the water evaporates from the coating film more rapidly than the coupling solvent and organic solvents, so the solubility of the one or more soluble gases continually increases.

Applicable coupling solvents include, but are not limited to, ethylene glycol ethers; propylene glycol ethers; chemical and physical combinations thereof; lactams; cyclic ureas; and the like.

The coating compositions employed in the present invention may also include pigments, pigment extenders, metallic flakes, fillers, drying agents, antifoaming agents, antiskinning agents, wetting agents, ultraviolet absorbers, cross-linking agents, and other additives well known in the art. A review of the use of coating additives in coating formulations is given by Lambourne, R., Editor, *Paint and Surface Coatings: Theory and Practice*, John Wiley & Sons, New York, 1987, the contents of which are incorporated herein by reference.

EXAMPLE 1

A coating formulation that gives a clear acrylic thermoset coating was prepared from 1) Rohm & Haas Acryloid™ AT-400 resin, which contains 75% acrylic polymer with a weight average molecular weight of 9,280 dissolved in 25% methyl amyl ketone, 2) Rohm & Haas Acryloid™ AT-954 resin, which contains 85% acrylic polymer with a weight average molecular weight of 6,070 dissolved in 15% methyl amyl ketone, and 3) American Cyanamid Cymel™ 323 resin, which is a cross-linking agent that contains 80% melamine polymer with a weight average molecular weight of 490 dissolved in 20% isobutanol solvent, by mixing the resins with solvents ethyl 3-ethoxypropionate (EEP), n-butanol, and methyl amyl ketone, and with Union Carbide Silwet/ L7602 surfactant, in the following proportions:

| | | |
|---|---|---|
| Acryloid ™ AT-400 | 8,150.6 g | 50.04% |
| Acryloid ™ AT-954 | 2,397.2 g | 14.72% |
| Cymel ™ 323 | 3,397.5 g | 20.86% |
| EEP | 1,111.3 g | 6.82% |
| n-butanol | 782.5 g | 4.80% |
| methyl amyl ketone | 400.0 g | 2.46% |
| Silwet/L7602 | 48.8 g | 0.30% |
| Total | 16,287.9 g | 100.00% |

The coating formulation had a high solids content of 66.73 weight percent and a viscosity of 670 centipoise. The component composition was:

| | | |
|---|---|---|
| AT-400 polymer | 6,113.0 g | 37.53% |
| AT-954 polymer | 2,037.6 g | 12.51% |
| Cymel ™ polymer | 2,718.0 g | 16.69% |
| methyl amyl ketone | 2,797.2 g | 17.18% |
| EEP | 1,111.3 g | 6.82% |
| n-butanol | 782.5 g | 4.80% |
| isobutanol | 679.5 g | 4.17% |
| Silwet/L7602 | 48.8 g | 0.30% |
| Total | 16,287.9 g | 100.00% |

The solvent fraction had the following composition and relative evaporation rate profile (butyl acetate=100):

| | | | |
|---|---|---|---|
| isobutanol | 679.5 g | 12.65% | 74 |
| n-butanol | 782.5 g | 14.57% | 44 |
| methyl amyl ketone | 2,797.2 g | 52.09% | 40 |
| EEP | 1,111.3 g | 20.69% | 11 |
| Total | 5,370.5 g | 100.00% | |

The solvent blend consisted of slow evaporating solvents that mainly evaporate during baking.

The solubility of carbon dioxide in the coating at one atmosphere partial pressure (14.5 psia) was measured to be 0.358 weight percent at room temperature (21C.).

The spray mixture was prepared and sprayed in a continuous mode by admixing the coating formulation with carbon dioxide, both pressurized to a spray pressure of 1600 psig, and heating the mixture to a spray temperature of 60 Celsius. The spray mixture was a clear single-phase solution that contained 29 weight percent dissolved carbon dioxide. Therefore the spray contained 0.41 gram of carbon dioxide per gram of coating formulation. The spray mixture was sprayed using a Nordson A7A automatic airless spray gun with Binks tip #9-0950, which has a 9-mil orifice size and an 8-inch fan width rating, using Spraying Systems tip insert #15153-NY.

Spray experiments were done using Bonderite™ 37 polished 24-gauge steel test panels and glass panels, both 6-inch by 12-inch in size. Panels were sprayed using a Spraymation automatic sprayer. The distance from the spray tip to the test panel was 12 inches. Uniform coatings of different thickness were sprayed by varying the traverse speed of the automatic sprayer with a 3-inch index distance. The test panels were sprayed in a vertical position. After a flash period, the coatings were baked vertically in an oven at a temperature of 250 Fahrenheit for one hour.

Spray droplet size was measured by laser diffraction using a Malvern type 2600 spray and droplet sizer (Malvern Instruments, Malvern, England). The sprayed wet coating was examined using a Bausch & Lomb stereoscopic microscope with 50 power magnification illuminated by a Cole-Parmer high intensity light source with two flexible fiber-optic light conduits. The dry film thickness of the cured coating was measured using a Microtest™ III Magnetic Coating Thickness Meter (Paul N. Gardner Company, Pompano Beach, Fla.). Coating gloss was measured using a Macbeth™ Novo-Gloss 20-degree Glossmeter (Paul N. Gardner Company, Pompano Beach, Fla.). Coating distinctness of image (DOI) was measured using a Model #1792 Distinctness of Reflected Image Meter (ATI Systems, Madison Heights, Mich.) and also a Model #300 Distinctness of Image Meter (Mechanical Design and Engineering Company, Burton, Mich.).

The spray was a feathered decompressive spray with a parabolic shape and a fan width of about 12 inches. The measured droplet size had a Sauter mean diameter of 24 microns.

A coating having a dry film thickness of 1.3 mil and a wet film thickness of 1.9 mil was sprayed onto a metal panel and examined for haze and entrapped bubbles. The just-sprayed wet film had visible haze that could be seen to be disappearing rapidly. Examination under the microscope showed that the entrapped bubbles were rapidly dissolving into the coating. No bubble migration was seen within the viscous coating or to the coating surface. No bubbles broke through the surface. All entrapped bubbles dissolved within about two minutes and the wet coating became free of haze. The coating was baked after a three-minute flash period. The baked coating was clear, smooth, and glossy and was free of haze, entrapped bubbles, surface pitting, and solvent popping.

A coating having a dry film thickness of 2.0 mils and a wet film thickness of 3.0 mils was sprayed onto a metal panel. The just-sprayed wet film had a moderate haze level that was higher than the previous thinner coating. Examination under the microscope showed a range of entrapped bubble sizes with most bubbles being between about 10 to 20 microns in diameter. All of the entrapped bubbles dissolved into the coating within two to three minutes. The smaller bubbles dissolved into the coating faster than the larger bubbles. No bubble migration was seen within the viscous coating or to the coating surface. No bubbles broke through the surface. The wet coating became free of haze. The coating was baked after a three-minute flash period. The baked coating was clear, smooth, and glossy and had high distinctness of image. It was free of haze, entrapped bubbles, surface pitting, and solvent popping.

An identical coating was sprayed onto a glass panel. The initial haze level of the just-sprayed wet film could be seen by looking through the clear coating and the glass panel. The haze could be readily seen to diminish and disappear within a three minute flash period in the same manner as observed for the metal panel. The baked coating was totally clear and free of haze and entrapped bubbles.

Thicker coatings having dry film thicknesses of 2.4, 2.6, and 3.0 mils and wet film thicknesses of 3.6, 3.9, and 4.5 mils, respectively, were similarly sprayed onto metal panels with similar results. The thicker coatings tended to have heavier initial haze levels than the thinner coatings. The haze was seen to dissipate and disappear within about three to four minutes. The baked coatings were clear, smooth, and glossy and had high distinctness of image. They did not run or sag. They were free of haze, entrapped bubbles, surface pitting, and solvent popping.

The coatings had the following properties:

| Dry Film Thickness | Wet Film Thickness | 20-Degree Gloss | MDEC DOI | ATI DOI |
|---|---|---|---|---|
| 1.3 mil | 1.9 mil | 87% | 75% | 40% |
| 2.0 mil | 3.0 mil | 93% | 90% | 71% |
| 2.4 mil | 3.6 mil | 93% | 95% | 77% |
| 2.6 mil | 3.9 mil | 94% | 95% | 77% |
| 3.0 mil | 4.5 mil | 93% | 90% | 71% |

The above results show that the decompressive spray produced by the Binks spray tip on the Nordson spray gun has a gas core with a high concentration of soluble carbon dioxide and that it is not significantly disrupted by entrainment of ambient air into the outer portions of the spray. Therefore, the gas bubbles that become entrapped in the coating film are formed from gas having a high concentration of carbon dioxide, which readily dissolves into the coating film and causes the bubbles to shrink and disappear.

For comparison, the same spray mixture was sprayed under the same conditions using a Graco AA-3000 air assisted airless spray gun with spray tip #182–309, which also has a 9-mil orifice size and an 8-inch fan width rating, but with no air assist used, so that it functioned as an airless spray gun. The Nordson and Graco spray guns were installed in series so that the same spray mixture could be sprayed from either one.

The spray produced was also a feathered decompressive spray with a parabolic shape and a fan width of about 12 inches. The measured droplet size had a Sauter mean diameter of 29 microns, which is nearly the same as that produced by the Binks spray tip on the Nordson spray gun.

A coating having a dry film thickness of 2.5 mils and a wet film thickness of about 3.7 mils was sprayed onto a metal panel. The just-sprayed wet film had a moderately heavy haze level that reduced in intensity but not rapidly. Examination under the microscope showed that the entrapped bubbles had about the same range of sizes as those produced by the Binks spray tip on the Nordson spray gun, with most bubbles being between about 10 and 20 microns in diameter. The bubbles dissolved into the coating film initially, which caused the haze level to decrease, but the dissolution rate slowed with time. The smaller bubbles shrank more quickly than the larger ones, which took much longer. No bubble migration was seen within the viscous coating or to the coating surface. No bubbles broke through the surface. After ten minutes, the haze was diminished but still visible and the larger bubbles, although shrunk in size, still remained in the coating. The coating was baked after the ten minute flash period. The baked coating was not smooth or glossy or clear and had a high haze level. Examination under the microscope showed that this was due to a high level of entrapped bubbles and larger solvent popping bubbles caused by the entrapped bubbles during baking. Although the bubbles were embedded within the coating, many were just under the surface and raised the surface locally, giving it a rough appearance. Solvent loss during baking would cause this by causing the coating film to become thinner, thereby bringing the coating surface close to the entrapped bubbles. The coating had the following properties:

| Dry Film Thickness | Wet Film Thickness | 20-Degree Gloss | MDEC DOI | ATI DOI |
|---|---|---|---|---|
| 2.5 mil | 3.7 mil | 13% | <50% | 10% |

Another coating was sprayed onto a metal panel and flashed for just three minutes before being baked, which is the same flash time as the coatings sprayed with the Binks spray tip on the Nordson spray gun. During this period, the haze level improved as bubbles dissolved slowly, but it was still visible after three minutes. The baked coating was totally covered with entrapped bubbles and with solvent popping bubbles caused by the entrapped bubbles. The bubble density was higher than in the previous coating. Examination under the microscope showed that although the bubbles were embedded in the coating they raised the surface, which gave it a rough appearance. The measured gloss level was just 5% and there was no reflected image from the coating.

A glass panel was sprayed with the Graco spray tip and spray gun in the same manner as the previous glass panel was sprayed with the Binks spray tip on the Nordson spray gun. The haze level could be seen to diminish during the flash period but it was still visible after three minutes, when the panel was baked. The baked coating was covered entirely with entrapped bubbles and solvent popping bubbles caused by the entrapped bubbles. Examination under the microscope showed that the bubbles were embedded inside the coating.

These results show that the decompressive spray produced by the Graco spray tip on the Graco spray gun produced turbulent mixing of ambient entrainment air into the core of the spray. Therefore the gas in the core had a lower concentration of soluble carbon dioxide than the decompressive spray produced by the Binks spray tip on the Nordson spray gun. Therefore, the entrapped bubbles formed in the wet coating film also had a lower concentration of carbon dioxide. This caused the carbon dioxide to dissolve more slowly into the wet film and the rate to drop off as the carbon dioxide became depleted from the bubbles. This left air bubbles remaining in the coating, although the haze level had been reduced. Air bubbles did not migrate from this viscous coating during baking because the acrylic polymer has a moderately high molecular weight, so baking caused the cross-linking reaction to rapidly increase the viscosity and solidify the coating. Solvent evaporated into the bubbles and the entrapped vapor expanded as it was heated, which caused the entrapped bubble size to increase as solvent popping bubbles.

For another comparison, the coating formulation was diluted to give 28 weight percent methyl ethyl ketone. The diluted coating was then sprayed without carbon dioxide by using the Binks spray tip on the Nordson spray gun, which produced a conventional airless spray. Coatings were sprayed having dry film thicknesses of 1.2, 1.5, 1.8, and 2.2 mils. The air entrapment haze did not dissolve during a three-minute flash period and became baked into the coatings. Examination under the microscope shows that the haze in the baked coatings is caused by air entrapment bubbles in the coatings.

EXAMPLE 2

The same coating formulation and spray mixture as in Example 1 were sprayed at the same temperature and pressure using the Graco AA-3000 spray gun with the same spray tip. Carbon dioxide gas was supplied to the spray by passing it through the atomization assist gas ports of the spray gun at a pressure of 40 psig. The carbon dioxide flow rate was measured by a mass flow meter to be 180 grams/minute. No shaping gas was used. The atomization ports are located on opposite sides of the plane of the spray fan and perpendicular to it at a distance of one half inch from the spray orifice. The gas exits through two small ports on each side. The ports (orifices) have a diameter of about 0.8 millimeters and they are 3.5 millimeters apart. The ports direct high velocity jets of gas directly against the spray orifice. With conventional airless sprays, the gas jets impact and atomize the liquid film of coating material that exits the spray orifice at high velocity. The liquid film is shaped into a flat plane by a groove cut through the end of the orifice piece. But the gas jets do not assist or affect atomization of a decompressive spray, which atomizes by a different atomization mechanism, namely, by very rapid expansion of the carbon dioxide released from solution as it undergoes rapid depressurization in the spray orifice. The carbon dioxide gas jets from the atomization assist ports only provide a carbon dioxide gas atmosphere to the spray.

The spray was a feathered decompressive spray with a parabolic shape and a fan width of about 12 inches. The spray shape and fan width were not changed by the carbon dioxide gas flow from the atomization assist ports. The measured droplet size had a Sauter mean diameter of 27 microns, which is the same droplet size as that produced in Example 1, where no assist gas was used. This shows that the carbon dioxide gas supplied to the spray through the atomization assist ports did not assist atomization of the decompressive spray. The ratio of total carbon dioxide gas supplied to the spray, by both the gas jets and the carbon dioxide in the spray mixture, to the coating formulation sprayed, from the measured spray rate, was 1.30 grams of carbon dioxide per gram of coating formulation.

A coating was sprayed onto a metal panel in the same manner as the coating sprayed in Example 1 with no assist gas. The coating had a dry film thickness of 2.5 mils and a wet film thickness of 3.7 mils, which is the same thickness as the coating in Example 1. This shows that the carbon dioxide gas jets did not affect deposition of the coating from the spray. The wet coating film had the same level of visible haze as the coating sprayed in Example 1. Examination under the microscope showed that the entrapped bubbles had about the same size range as in Example 1 and that the bubbles were dissolving into the coating. But unlike in Example 1, the bubbles continued to dissolve until they disappeared. No bubble migration was seen within the viscous coating or to the coating surface. Most of the visible haze and entrapped bubbles dissolved within three minutes and the remaining largest bubbles, which dissolved more slowly, dissolved completely within five minutes. The coating was baked after the five minute flash period. The baked coating was clear, smooth, and glossy and free of haze, entrapped bubbles, surface pitting, and solvent popping caused by entrapped bubbles. The coating had the following properties:

| Dry Film Thickness | Wet Film Thickness | 20-Degree Gloss | MDEC DOI | ATI DOI |
|---|---|---|---|---|
| 2.5 mil | 3.7 mil | 94% | 85% | 62% |

For comparison, a coating with a dry film thickness of 2.5 mils and a wet film thickness of 3.7 mils was sprayed using air as the assist gas instead of carbon dioxide. Examination of the wet coating film under the microscope showed that although the entrapped bubbles shrank some in size, they were still present after about twenty minutes and the haze was still visible. The baked coating was covered with air entrapment bubbles and haze.

EXAMPLE 3

The viscous coating formulation used in Example 1 was diluted to give a coating formulation containing 16.8 weight percent acetone and a low viscosity of 91 centipoise (23 C.). The diluted formulation was sprayed using a Devilbiss model JGA-502 air spray gun with air cap #30. The spray gun was operated using carbon dioxide gas at a pressure of 40 psig. The carbon dioxide flow rate was measured by a mass flow meter to be about 300 grams/minute. The spray contained 1.41 grams of carbon dioxide per gram of coating formulation sprayed. The spray had a feathered spray fan and a width of about 8 inches. The measured droplet size had a Sauter mean diameter of 27 microns, which is the same as that produced by decompressive atomization of the viscous coating formulation in Examples 1 and 2. A coating was sprayed having a dry film thickness of 1.7 mil. The coating initially had a high level of gas entrapment haze. Examination of the wet coating film under the microscope showed that entrapped bubbles as those produced by the decompressive spray in Examples 1 and 2. The entrapped bubbles dissolved during the flash period and the haze disappeared. Some entrapped bubbles migrated to the coating surface. The baked coating was clear, smooth, and glossy and free of haze. Examination under the microscope showed that no entrapped bubbles were baked into the coating. The coating had some orange peel due to solvent loss from the spray, which shows that the deposited coating had relatively high viscosity. The coating had the following properties:

| Dry Film Thickness | 20-Degree Gloss | MDEC DOI | ATI DOI |
|---|---|---|---|
| 1.7 mil | 83% | 70% | 36% |

For comparison, a coating was sprayed in the same manner but with the spray gun operated using air instead of carbon dioxide. The spray was unchanged and the measured droplet size had a Sauter mean diameter of 28 microns, which is the same as that produced using carbon dioxide instead of air. The coating had a dry film thickness of 1.7 mil. The coating had the same high level of entrapment haze. Examination under the microscope showed that the entrapped air bubbles had the same range of bubble size but the bubbles did not dissolve into the coating. The haze persisted during the flash period and diminished little due to some migration of bubbles to the surface. The baked coating was covered with a heavy level of haze. Examination under the microscope showed a wide range of fine air entrapment bubbles baked into the coating with some larger solvent pop bubbles. The bubbles baked into the coating had about the same size distribution as the bubbles seen in the wet coating. The coating had a much poorer appearance than the coating sprayed using carbon dioxide; it had the following properties:

| Dry Film Thickness | 20-Degree Gloss | MDEC DOI | ATI DOI |
|---|---|---|---|
| 1.7 mil | 43% | <50% | 15% |

EXAMPLE 4

A coating formulation that gives a clear acrylic thermoset coating at a higher solids level than the coating in Examples 1 and 2, by using a lower molecular weight polymer, was prepared from Acryloid™ AT-954 resin and Cymel™ 323 resin, by mixing the resins with ethyl 3- ethoxypropionate (EEP) and Silwet/ L7602 surfactant, in the following proportions:

| | | |
|---|---|---|
| Acryloid ™ AT-954 | 10,500.0 g | 70.00% |
| Cymel ™ 323 | 3,600.0 g | 24.00% |
| EEP | 840.0 g | 5.60% |
| Silwet/L7602 | 60.0 g | 0.40% |
| Total | 15,000.0 g | 100.00% |

The coating formulation had a high solids content of 78.70 weight percent and a viscosity of about 3000 centipoise (23 C.). The component composition was:

| | | |
|---|---|---|
| AT-954 polymer | 8,925.0 g | 59.50% |
| Cymel ™ polymer | 2,880.0 g | 19.20% |
| methyl amyl ketone | 1,575.0 g | 10.50% |
| EEP | 840.0 g | 5.60% |
| isobutanol | 720.0 g | 4.80% |
| Silwet/L7602 | 60.0 g | 0.40% |
| Total | 15,000.0 g | 100.00% |

The solvent fraction had the following composition and relative evaporation rate profile (butyl acetate=100):

| | | | |
|---|---|---|---|
| isobutanol | 720.0 g | 22.97% | 74 |
| methyl amyl ketone | 1,575.0 g | 50.24% | 40 |
| EEP | 840.0 g | 26.79% | 11 |
| Total | 3,135.0 g | 100.00% | |

The solvent blend consisted of slow evaporating solvents that mainly evaporate during baking.

The spray mixture was prepared and sprayed in a continuous mode by admixing the coating formulation with carbon dioxide, both pressurized to a spray pressure of 1600 psig, and heating the mixture to a spray temperature of 58 Celsius. The spray mixture was a clear single-phase solution that contained 28 weight percent dissolved carbon dioxide. The spray contained 0.39 grams of carbon dioxide per gram of coating formulation. The spray mixture was sprayed using a Nordson A7A automatic airless spray gun with Binks tip #9-0950 and Spraying Systems tip insert #15153-NY. The spray was a feathered decompressive spray with a parabolic shape and a fan width of about 12 inches. The measured droplet size had a Sauter mean diameter of 25 microns.

A coating having a dry film thickness of 2.5 mils and a wet film thickness of 3.1 mils was sprayed onto a metal panel and examined for haze and entrapped bubbles. The just-sprayed wet film had a substantial level of visible haze. Examination of the wet film under the microscope showed a high density of entrapped bubbles with little bubble dissolution activity. Most of the bubbles were 10 to 20 microns in diameter, with the largest being 25 to 30 microns in diameter and the smallest being about 5 microns in diameter. The bubble dissolution rate was very slow, which shows that the bubbles contained a high concentration of air that had been mixed into the carbon dioxide in the core of the decompressive spray. Therefore the bubbles shrank some as the carbon dioxide content dissolved, but did not disappear because the air content remained. No bubble migration was seen within the viscous coating or to the coating surface. Because of the high solids level, the film thickness decreased relatively little from solvent evaporation. The bubble haze level decreased by about 50 percent after about five minutes.

A thinner coating having a dry film thickness of 1.8 mil and a wet film thickness of 2.2 mils was sprayed in a similar manner. The just sprayed coating had a substantial level of visible haze. The bubbles slowly shrank but did not disappear. No migration of bubbles was observed. The bubble haze level decreased by about 50 percent after about five minutes.

A coating was then sprayed in the same manner but with a carbon dioxide atmosphere supplied to the decompressive spray using a distribution system consisting of four ¼-inch copper tubes positioned with two outlets on each side of the spray fan at a distance of one inch from the spray and one inch above and below the spray centerline. The carbon dioxide discharged against the spray at a slight angle in the downstream direction. Low pressure carbon dioxide was supplied to the distribution system at a total flow rate of 300 grams/minute. The ratio of total carbon dioxide gas supplied to the spray, by both the distribution system and the carbon dioxide in the spray mixture, to the coating formulation sprayed, from the measured spray rate, was 2.91 grams of carbon dioxide per gram of coating formulation.

The spray was a feathered decompressive spray with a parabolic shape and a fan width of about 12 inches. The spray shape and fan width were not changed by the carbon dioxide gas flow from the gas distribution system. The carbon dioxide gas flow did not assist formation of the spray because of the flow had low velocity and was diffuse. The coating had a dry film thickness of 1.8 mil and a wet film thickness of 2.2 mils, which is the same as that sprayed without the carbon dioxide gas flow. This shows that the carbon dioxide did not affect coating deposition from the spray. The just sprayed coating initially had the same substantial level of visible haze as the coating sprayed without the carbon dioxide flow. Examination of the wet film under the microscope showed a high density of entrapped bubbles but the bubbles were noticeably dissolving into the coating at a much higher rate than the coating sprayed without the carbon dioxide flow. No bubble migration was seen within the viscous coating or to the coating surface. The entrapped bubbles were mostly dissolved after about three minutes and they were virtually entirely gone after five minutes. This shows that the entrapped bubbles had a high concentration of carbon dioxide with little air. The baked coating was clear and smooth with high gloss and distinctness of image and had no haze or entrapped bubbles. The coating had the following properties:

| Dry Film Thickness | Wet Film Thickness | 20-Degree Gloss | MDEC DOI | ATI DOI |
|---|---|---|---|---|
| 1.8 mil | 2.2 mil | 88% | 90% | 65% |

For comparison, a coating was sprayed in the same manner but with a much higher flow rate of carbon dioxide gas of about 500 grams/minute. The flow ratio was 4.60 grams of carbon dioxide per gram of coating formulation. The coating had the same thickness and the haze bubbles dissolved into the coating in the same manner. The haze and bubbles were fully dissolved within five minutes.

EXAMPLE 5

The same coating formulation and spray mixture as in Example 4 were sprayed at a pressure of 1600 psig and a temperature of 57 Celsius by using the Graco AA-3000 air assisted airless spray gun with spray tip #182–309.

A coating having a dry film thickness of 2.5 mils and a wet film thickness of 3.2 mils was sprayed onto a metal panel by using the spray gun with no air assist, so it functioned as an airless spray gun. The spray contained 0.39 gram of carbon dioxide per gram of coating formulation. The spray was a feathered decompressive spray with a parabolic shape and a fan width of about 12 inches. The measured droplet size had a Sauter mean diameter of 32 microns. The just-sprayed wet coating film showed heavy visible haze. Examination under the microscope showed a heavy concentration of entrapped bubbles with little dissolution of the bubbles. The bubbles appeared to shrink a bit and then stop, which showed that they contained some carbon dioxide but mainly air. The bubbles had the same size range as those produced by the Binks spray tip on the Nordson spray gun in Example 4. No migration of bubbles was observed within the viscous coating or to the coating surface. After five minutes the haze and bubbles showed only a little diminution. After ten minutes the haze and bubbles were much the same as they were after five minutes.

A coating was then sprayed in the same manner with a flow of carbon dioxide gas supplied to the spray by passing it through the atomization assist gas ports of the spray gun at a pressure of 40 psig. The carbon dioxide gas flow rate was measured to be 175 grams/minute. No shaping gas was used. The spray shape and fan width were not changed by the gas flow from the atomization assist ports. The measured droplet size had a Sauter mean diameter of 33 microns, which is the same as that produced with no atomization assist gas. Therefore the gas flow from the atomization assist ports did not assist atomization of the decompressive spray. The coating had a dry film thickness of 2.5 mils, which shows that the carbon dioxide flow did not affect deposition of the coating from the spray. The ratio of total carbon dioxide gas supplied to the spray, by both the gas flow and carbon dioxide in the spray mixture, to the coating formulation sprayed, from the measured spray rate, was 1.11 grams of carbon dioxide per gram of coating formulation. The just-sprayed wet coating film showed the same heavy visible haze as the coating sprayed without the carbon dioxide flow. Examination under the microscope showed that the entrapped bubbles were dissolving and shrinking. No migration of bubbles was seen within the viscous coating or to the coating surface. After five minutes the bubble entrapment and haze level had decreased 50 to 70 percent, but a population of bubbles still remained in the coating.

A coating was then sprayed with carbon dioxide supplied to the atomization assist gas ports at a pressure of 60 psig. The carbon dioxide gas flow rate was about 260 grams/minute. The spray shape and fan width were not changed by the gas flow. The coating had the same dry film thickness of 2.5 mils. The flow ratio was 1.46 grams of carbon dioxide per gram of coating formulation. The coating film showed the same heavy visible haze as before. Examination under the microscope showed that the entrapped bubbles were readily dissolving and shrinking. No migration of bubbles was seen within the viscous coating or to the coating surface. After five minutes the bubble entrapment and haze level had decreased 80 to 90 percent. After ten minutes only a few widely scattered bubbles remained, which could not be seen without the microscope; they resulted from the largest bubbles having shrunk to a small size.

A coating was then sprayed with carbon dioxide supplied to the atomization assist gas ports at a pressure of 80 psig. The carbon dioxide gas flow rate was about 350 grams/minute. The spray shape and fan width were not changed by the gas flow. The coating had the same dry film thickness of 2.5 mils. The flow ratio was 1.83 grams of carbon dioxide per gram of coating formulation. The coating film showed the same heavy visible haze. Examination under the microscope showed that the entrapped bubbles were very noticeably dissolving and more quickly than before. This shows that the entrapped bubbles contained a high concentration of carbon dioxide with little air. No migration of bubbles was seen within the viscous coating or to the coating surface. After five minutes the bubble entrapment and haze level was virtually totally gone, with only a few scattered bubbles left, which could not be seen without the microscope. These bubbles finished dissolving a few minutes later. In general, the bubble dissolution rate is slower than in the coating used in Examples 1 to 3, which has a lower solids level and therefore a higher level of solvent, which increases carbon dioxide solubility in the coating and may increase the diffusion rate through the coating. The baked coating was clear and smooth with high gloss and distinctness of image and had no haze or entrapped bubbles. The coating had the following properties:

| Dry Film Thickness | Wet Film Thickness | 20-Degree Gloss | MDEC DOI | ATI DOI |
|---|---|---|---|---|
| 2.5 mil | 3.2 mil | 88% | 90% | 80% |

EXAMPLE 6

Using the same coating formulation, spray mixture, spray conditions, spray gun, and spray tip as in Example 5, a thinner coating was sprayed having a dry film thickness of 1.5 mil and a wet film thickness of 1.9 mil by using the spray gun with no air or carbon dioxide assist gas, so it functioned as an airless spray gun. The spray contained 0.39 gram of carbon dioxide per gram of coating formulation. The thinner wet film contained less intense visible haze than the heavy haze in Example 5. Examination under the microscope showed that the entrapped bubbles were finer in size, being predominantly about 5 to 15 microns in diameter. The bubbles also dissolved faster. No bubble migration was seen within the viscous coating or to the coating surface. After five minutes the haze was significantly diminished but still visible.

A coating was then sprayed in the same manner but with carbon dioxide supplied to the atomization assist gas ports at a pressure of 60 psig. The spray shape and fan width were not changed by the gas flow. The coating had the same dry film thickness of 2.5 mils. The flow ratio was 1.46 grams of carbon dioxide per gram of coating formulation sprayed. The wet coating film showed the same initial visible haze as before. Examination under the microscope showed that the entrapped bubbles were the same size but were readily dissolving and shrinking. No migration of bubbles was seen within the viscous coating or to the coating surface. The entrapped bubbles were essentially totally dissolved after three minutes; only the largest bubbles remained, which were totally dissolved within five minutes.

The baked coating was clear and smooth with high gloss and distinctness of image and had no haze or entrapped bubbles. The coating had the following properties:

| Dry Film Thickness | Wet Film Thickness | 20-Degree Gloss | MDEC DOI | ATI DOI |
|---|---|---|---|---|
| 2.5 mil | 3.2 mil | 92% | 90% | 77% |

EXAMPLE 7

Using the same coating formulation, spray mixture, spray conditions, spray gun, and spray tip as in Example 5, a thicker coating was sprayed having a dry film thickness of 3.5 mils and a wet film thickness of 4.2 mils by using the spray gun with no air or carbon dioxide assist gas, so it functioned as an airless spray gun. The spray contained 0.39 gram of carbon dioxide per gram of coating formulation. The thicker wet film contained heavy visible haze like in Example 5. Examination under the microscope showed that the entrapped bubbles had about the same size range. Examination under the microscope showed a heavy concentration of entrapped bubbles with little dissolution of the bubbles. No bubble migration was seen within the viscous coating or to the coating surface. After five minutes the haze and bubbles showed only a little diminution.

A coating was then sprayed in the same manner but with carbon dioxide supplied to the atomization assist gas ports at a pressure of 40 psig. The spray shape and fan width were not changed by the gas flow. The coating had the same dry film thickness of 3.5 mils. The flow ratio was 1.11 grams of carbon dioxide per gram of coating formulation sprayed. The wet coating film showed about the same initial visible haze as before. Examination under the microscope showed that the entrapped bubbles were the same size but were dissolving and shrinking. No migration of bubbles was seen within the viscous coating or to the coating surface. After five minutes the bubble entrapment and haze level had decreased 50 to 70 percent.

The baked coating was clear and smooth with high gloss and distinctness of image and had no haze or entrapped bubbles. The coating had the following properties:

| Dry Film Thickness | Wet Film Thickness | 20-Degree Gloss | MDEC DOI | ATI DOI |
|---|---|---|---|---|
| 3.5 mil | 4.2 mil | 90% | 90% | 77% |

EXAMPLE 8

A nitrocellulose coating formulation was used that gives a clear, air dry coating with a low gloss finish. The formulation contained high molecular weight thermoplastic polymers at a solids level of 38 weight percent dissolved in a blend of methyl amyl ketone and other solvents. The viscosity was 848 centipoise (23 C.).

The spray mixture was prepared and sprayed in a continuous mode by admixing the coating formulation with carbon dioxide, both pressurized to a spray pressure of 1500 psig, and heating the mixture to a spray temperature of 50 Celsius. The spray mixture was a single-phase solution that contained 30 weight percent dissolved carbon dioxide. The spray contained 0.43 grams of carbon dioxide per gram of coating formulation. The spray mixture was sprayed by using the Graco AA-3000 air assisted airless spray gun with spray tip #182–309.

The spray was in the transition spray region between liquid-film atomization and decompressive atomization; no liquid film was visible at the spray orifice and good atomization was obtained, but the spray was angular and not parabolic in shape. The measured droplet size had a Sauter mean diameter of 33 microns. The spray fan width was about 9 inches at a distance of 12 inches from the spray tip. The coatings were sprayed using the automatic sprayer with a tip-to-panel distance of 12 inches. The coatings became hard by solvent evaporation at room conditions (no baking).

A thin coating having a dry film thickness of 0.7 mil and a wet film thickness of 1.8 mil was sprayed onto a metal panel by using the spray gun with no air or carbon dioxide assist gas, so it functioned as an airless spray gun. Examination of the wet film under the microscope showed that the entrapped bubbles were dissolving very quickly. All bubbles dissolved completely within about one minute. The hardened coating was clear and very smooth and had a nice low gloss finish. It contained no haze or entrapped bubbles.

A thicker coating having a dry film thickness of 1.3 mil and a wet film thickness of 3.4 mil was sprayed onto a metal panel by using the spray gun with no air or carbon dioxide assist gas. Examination of the wet film under the microscope showed that the entrapped bubbles were larger than those in the thinner coating. The bubbles were seen to readily dissolve into the coating. About 10 percent of the bubbles migrated to the coating surface. The remainder totally dissolved within four minutes and the haze was no longer visible. The hardened coating was clear and very smooth and had a nice low gloss finish. It contained no haze or entrapped bubbles.

A coating was then sprayed in the same manner but with carbon dioxide supplied to the atomization assist gas ports at a pressure of 40 psig. The spray shape, fan width, and atomization were not changed by the gas flow. The coating had the same dry film thickness of 1.3 mil, which shows that the gas flow did not change coating deposition from the spray. The flow ratio was 1.10 grams of total carbon dioxide per gram of coating formulation sprayed. Examination of the wet film under the microscope showed that the entrapped bubbles were the same size and were readily dissolving into the coating. Fewer bubbles migrated to the surface, perhaps because more solvent evaporated in the spray, so the coating was more viscous. The entrapped bubbles totally dissolved into the coating within four minutes and the haze was no longer visible. The hardened coating had the same appearance, being clear and very smooth with a nice low gloss finish. It contained no haze or entrapped bubbles.

A thicker coating having a dry film thickness of 1.7 mil and a wet film thickness of 4.5 mil was sprayed with carbon dioxide supplied to the atomization assist gas ports at a pressure of 40 psig. Examination of the wet film under the microscope showed that the bubbles were dissolving into the coating about the same as in the thinner coatings. About 10 percent of the bubbles migrated to the coating surface. The entrapped bubbles totally dissolved within four minutes and the haze was no longer visible. The hardened coating was clear and very smooth and had a nice low gloss finish. It contained no haze or entrapped bubbles.

EXAMPLE 9

A coating formulation that gives a clear acrylic thermoplastic coating was prepared from Rohm & Haas Acryloid™

B-66 resin, which has a weight average molecular weight of 45,290, by dissolving the resin in methyl amyl ketone solvent at a solids level of 38.5 weight percent. The viscosity was about 350 centipoise.

The solubility of carbon dioxide in the coating at one atmosphere partial pressure (15.1 psia) was measured to be above 0.578 weight percent at room temperature (27 C.).

The spray mixture was prepared and sprayed in a continuous mode by admixing the coating formulation with carbon dioxide, both pressurized to a spray pressure of 1600 psig, and heating the mixture to a spray temperature of 58 Celsius. The spray mixture was a single-phase solution that contained 35 weight percent dissolved carbon dioxide. The spray contained 0.54 grams of carbon dioxide per gram of coating formulation. The spray mixture was sprayed by using the Nordson A7A airless spray gun with Binks tip #9-0950 and Spraying Systems tip insert #15153-NY. The spray was a feathered decompressive spray with a parabolic shape and a fan width of about 11 inches. The coatings became hard by solvent evaporation at room conditions (no baking).

A coating having a dry film thickness of 1.2 mil and a wet film thickness of 3.1 mils was sprayed onto a metal panel. The just-sprayed wet film had light to moderate visible haze. Examination under the microscope showed that the bubbles were dissolving rapidly into the coating with little or no migration of bubbles to the surface. The hardened coating was clear, very smooth, and glossy. It contained no haze or surface pitting from bubbles migrating through the surface as the coating dried. Examination under the microscope showed that it contained no entrapped bubbles.

A coating was then sprayed in the same manner but with carbon dioxide supplied to the spray using the distribution system described in Example 4. Low pressure carbon dioxide gas was supplied at a flow rate of 210 grams/minute. The flow ratio was 2.31 grams of total carbon dioxide per gram of coating formulation sprayed. The gas flow did not affect the shape, width, or appearance of the spray. The same dry film thickness of 1.2 mil was obtained, which shows that the gas flow did not affect deposition of coating from the spray. The wet film had the same initial level of haze. Examination under the microscope showed that the bubbles, even the largest, were dissolving very rapidly into the coating, with few if any bubbles migrating to the surface. The hardened coating was clear, very smooth, and glossy. It contained no haze or surface pitting. Examination under the microscope showed that it contained no entrapped bubbles.

A coating was then sprayed in the same manner but with carbon dioxide supplied to the spray at a higher flow rate of 310 grams/minute. The flow ratio was 3.15 grams of total carbon dioxide per gram of coating formulation sprayed. The results were the same as those for the lower flow rate. The bubbles, even the largest, dissolved very rapidly into the coating. The hardened coating was clear, very smooth, and glossy, and contained no haze, surface pitting, or entrapped bubbles.

A thicker coating having a dry film thickness of 2.3 mils and a wet film thickness of 6.0 mils was sprayed with carbon dioxide supplied to the spray at the flow rate of 210 grams/minute. The initial visible haze level was higher than in the thinner coatings. Examination under the microscope showed that the bubbles, even the largest, were rapidly dissolving into the coating with little migration of bubbles to the surface. The bubbles were totally dissolved within a few minutes. The hardened coating was clear, very smooth, and glossy. It contained no haze or surface pitting. Examination under the microscope showed that it contained no entrapped bubbles.

For comparison, the coating formulation was diluted with acetone and sprayed using the DeVilbiss model JGA-502 air spray gun with air cap #30. The spray gun was operated using air. The coating had a dry film thickness of 2.4 mils, the same as the previous coating. The coating had a moderate haze level that did not dissolve into the coating. Some migration of bubbles occurred to the coating surface.

The hardened coating had visible haze and the surface was not smooth, because it was covered with pitting caused by air entrapment bubbles that broke through the surface as the coating film dried by solvent evaporation. Examination under the microscope showed that air bubbles were entrapped inside the hard coating, which caused the hazy appearance.

EXAMPLE 10

A coating formulation that gives a clear polyester thermoset coating was prepared from Spencer Kellog Aroplaz™ 6025-A6-80 resin, which contains 80 % polyester polymer with a weight average molecular weight of 3,270 dissolved in 20% methyl PROPASOL/acetate (MPA), and Cymel™ 323 resin, by mixing the resins with n-butanol and butyl CELLOSOLVE/ acetate (BCA) and with 50% Union Carbide Silwet/ L5310 surfactant dissolved in xylene, in the following proportions:

| | | |
|---|---|---|
| Aroplaz ™ 6025-A6-80 | 11,000.0 g | 63.07% |
| Cymel 323 | 3,666.7 g | 21.02% |
| n-butanol | 450.0 g | 2.58% |
| BCA | 2,250.0 g | 12.90% |
| Silwet/L5310 | 75.0 g | 0.43% |
| Total | 17,441.7 g | 100.00% |

The coating formulation had a high solids content of 67.27 weight percent and a viscosity of 990 centipoise. The component composition was:

| | | |
|---|---|---|
| Aroplaz ™ polymer | 8,800.0 g | 50.45% |
| Cymel ™ polymer | 2,933.4 g | 16.82% |
| BCA | 2,250.0 g | 12.90% |
| MPA | 2,200.0 g | 12.61% |
| isobutanol | 733.3 g | 4.20% |
| n-butanol | 450.0 g | 2.58% |
| xylene | 37.5 g | 0.22% |
| Silwet/L5310 | 37.5 g | 0.22% |
| Total | 17,441.7 g | 100.00% |

The solvent fraction had the following composition and relative evaporation rate profile (butyl acetate=100):

| | | | |
|---|---|---|---|
| isobutanol | 733.3 g | 12.94% | 74 |
| xylene | 37.5 g | 0.66% | 70 |
| n-butanol | 450.0 g | 7.93% | 44 |
| MPA | 2,200.0 g | 38.80% | 34 |
| BCA | 2,250.0 g | 39.67% | 3 |

The solvent blend consisted of slow evaporating solvents that mainly evaporate during baking.

The solubility of carbon dioxide in the coating at one atmosphere partial pressure (15.2 psia) was measured to be 0.338 weight percent at room temperature (27 C.).

The spray mixture was prepared and sprayed in a continuous mode by admixing the coating formulation with carbon dioxide, both pressurized to a spray pressure of 1600 psig, and heating the mixture to a spray temperature of 70

Celsius. The spray mixture was a clear single-phase solution that contained 25.5 weight percent dissolved carbon dioxide. The spray contained 0.34 grams of carbon dioxide per gram of coating formulation. The spray mixture was sprayed using a Nordson A7A automatic airless spray gun with Spraying Systems tip #500011 with insert #15153-NY and also with Nordson tips #016-012 and 016-011, each of which has a 9-mil orifice size and fan width ratings of 8, 4, and 2 inches, respectively.

The sprays were feathered decompressive sprays with a parabolic shape. The spray tips gave the following fan widths:

| Spray Tip | Fan Width Rating | Fan Width Measured |
|---|---|---|
| 500011 | 8 inch | 18 inch |
| 016-012 | 4 inch | 11 inch |
| 016-011 | 2 inch | 8 inch |

Coatings were sprayed with each spray tip over a range of thicknesses from thin to thick by varying the traverse speed of the Spraymation automatic sprayer with a 3-inch index. The coatings were allowed to flash for exactly three minutes and then they were baked in an oven at a temperature of 300 Fahrenheit for 30 minutes. For each tip, the initial haze level increased with coating thickness and took longer to dissolve into the coatings. No bubble migration to the surface was observed. For each spray tip, the haze in the coatings with a dry film thickness below about 2.0 mil dissolved within the three minute flash period. The coatings were clear, smooth, and glossy and the surface was free of pitting. They were free of haze and examination under the microscope showed that they were free of entrapped bubbles.

| Spray Tip | Dry Film Thickness | Wet Film Thickness | 20-Degree Gloss | MDEC DOI |
|---|---|---|---|---|
| 500011 | 1.0 mil | 1.5 mil | 90% | 85% |
| 500011 | 1.2 mil | 1.8 mil | 93% | 92% |
| 500011 | 1.3 mil | 1.9 mil | 94% | 95% |
| 500011 | 1.6 mil | 2.4 mil | 95% | 95% |
| 500011 | 1.7 mil | 2.5 mil | 96% | 95% |
| 500011 | 1.8 mil | 2.7 mil | 96% | 95% |
| 016-012 | 1.0 mil | 1.5 mil | 78% | |
| 016-012 | 1.2 mil | 1.8 mil | 81% | |
| 016-012 | 1.5 mil | 2.2 mil | 90% | |
| 016-012 | 2.0 mil | 3.0 mil | 93% | |
| 016-011 | 1.0 mil | 1.5 mil | 77% | |
| 016-011 | 1.2 mil | 1.8 mil | 82% | |
| 016-011 | 1.5 mil | 2.2 mil | 88% | |
| 016-011 | 1.9 mil | 2.8 mil | 92% | |

The haze in coatings above 2.0 mil dry film thickness did not fully dissolve in three minutes and the haze became baked into the coatings and also caused pitting on the coating surface. Examination under the microscope showed that fine bubbles were trapped in the coatings.

EXAMPLE 11

A liquid coating composition is spray applied to a substrate with minimal entrapment of air bubbles in the coating by applying the coating within a closed cabinet wherein a first atmosphere is maintained comprising soluble carbon dioxide gas, which is supplied to the cabinet by purging at a rate sufficient to maintain at least 90 percent carbon dioxide by volume in the first atmosphere. The carbon dioxide is supplied as liquid from a refrigerated tank, depressurized, and heated to ambient temperature. The carbon dioxide level in the cabinet is controlled by measuring the level inside the cabinet and adjusting the flow of carbon dioxide into the cabinet accordingly, either manually or automatically.

The substrate is conveyed through the cabinet on a conveyor. From an entrance booth having active air flow through it, the substrate is conveyed into the cabinet at one end by passing it through an opening having a sliding door that opens only to admit the substrate and then closes. Active air flow through the entrance booth purges carbon dioxide and solvent vapors that periodically flow from the cabinet whenever the door opens, thereby purging solvent vapors from the cabinet. The substrate is sprayed as it is conveyed passed fixed or reciprocating automatic spray guns. After being sprayed, the coated substrate is conveyed out of the cabinet within one minute by passing through another opening at the other end having a sliding door that opens only to eject the coated substrate and then closes. The coated substrate exits the cabinet into an exit booth having active air flow through it wherein the coated substrate is subjected to a second atmosphere having less than 1 percent by volume carbon dioxide. In the exit booth, the active air flow purges the carbon dioxide and solvent vapors flowing periodically from the cabinet as the coated substrate passes through the open door. The air flow through the entrance and exit booths is great enough to maintain the carbon dioxide at a level well below the safe operating level. From the booth the coated substrate is conveyed to an air purged holding area for about three minutes. The carbon dioxide entrapped in gaseous bubbles within the coating dissolves into the coating, diffuses to the surface, and escapes into the second atmosphere, thereby alleviating the problem of entrapped bubbles in the coating. Solvents are also flashed from the coating. The coating is then conveyed into an oven where the coating is cured.

The cabinet has a safety interlock system and a warning system that prevent entrance to the cabinet by personnel unless the carbon dioxide flow is off and the cabinet is purged with sufficient air to reduce the carbon dioxide and solvent vapor levels to below safe limits.

What is claimed is:

1. A method for liquid spray application of coatings onto a substrate which minimizes entrapped non-soluble gaseous bubbles comprising:

a) forming a liquid coating composition containing at least one polymeric compound capable of forming a coating on a substrate;

b) spraying, without a viscosity-reducing diluent under supercritical conditions, into an environment of non-soluble gas or gases, said liquid coating composition toward asubstrate;

c) providing one or more gases which are soluble in said polymeric coating composition so as to create a first atmosphere encompassing the sprayed liquid coating composition, wherein said soluble gases are provided under conditions which cause the sprayed liquid to be applied to the substrate in said first atmosphere that contains the one or more soluble gases in a sufficiently high portion to alleviate entrapped non-soluble gases in the coating;

d) coating the substrate; and e) subjecting the coated substrate to a second atmosphere in which said one or more soluble gases are in lower concentration than in the first atmosphere so that the one or more soluble gases diffeuse from the coated substrate into said second atmosphere.

2.The method of claim 1, wherein the first atmosphere is a closed system containing said soluble gases.

3. The method of claim 1, wherein the second atmosphere contains the soluble gases in an amount less than 5 mole percent.

4. The method of claim 3, wherein the second atmoshere is air.

5. The method of claim 1 wherein the one or more soluble gases is supercritical carbon dioxide.

6. An apparatus for applying a liquid coating onto a substrate to minimize entrapped non-soluble gaseous bubbles comprising:

a) means for supplying at least one liquid coating composition containing at least one polymeric compound capable of forming a coating on a substrate;

b) means for supplying at least one substrate;

c) means for providing one or more gases which are soluble in said polymeric coating composition so as to create a first atmosphere encompassing the sprayed liquid coating composition wherein said soluble gases are provided under conditions which cause the sprayed liquid to be applied to the substrate in said first atmosphere that contains the one or more soluble gases in sufficiently high portion to alleviate entrapped non-soluble gas in the coating;

d) means for coating the substrate; and e) means for subjecting the coated substrate to a second atmosphere in which said one or more soluble gases are in lower concentration than in the first atmosphere so that the one or more soluble gases diffuse from the coated substrate into said second atmosphere;

wherein the spraying means is a spray gun having a discharge end and the means for providing the first atmosphere is a distributor plate positioned at said discharge end of the spray gun, said distributor plate having a perforated front face facing the spray as it leaves the discharge end and a back face facing away from the spray, and wherein the first atmosphere is provided by supplying said soluble gases through the perforated front face of the distributor plate.

* * * * *